US007093675B2

(12) United States Patent
Pia

(10) Patent No.: US 7,093,675 B2
(45) Date of Patent: Aug. 22, 2006

(54) DRILLING METHOD

(75) Inventor: Giancarlo Pia, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/343,687

(22) PCT Filed: Aug. 1, 2001

(86) PCT No.: PCT/GB01/03465

§ 371 (c)(1),
(2), (4) Date: Jan. 31, 2003

(87) PCT Pub. No.: WO02/10549

PCT Pub. Date: Feb. 7, 2002

(65) Prior Publication Data

US 2003/0141111 A1 Jul. 31, 2003

(30) Foreign Application Priority Data

Aug. 1, 2000 (GB) ..... 0018877.1

(51) Int. Cl.
*E21B 10/00* (2006.01)

(52) U.S. Cl. ..... 175/57; 175/171

(58) Field of Classification Search ..... 175/57, 175/171, 215, 257, 258, 320
See application file for complete search history.

(56) References Cited

U.S. PATENT DOCUMENTS

| | | | |
|---|---|---|---|
| 122,514 | A | 1/1872 | Bullock |
| 1,077,772 | A | 11/1913 | Weathersby |
| 1,185,582 | A | 5/1916 | Bignell |
| 1,301,285 | A | 4/1919 | Leonard |
| 1,342,424 | A | 6/1920 | Cotten |
| 1,418,766 | A | 6/1922 | Wilson |
| 1,471,526 | A | 10/1923 | Pickin |
| 1,585,069 | A | 5/1926 | Youle |
| 1,728,136 | A | 9/1929 | Power |
| 1,777,592 | A | 10/1930 | Thomas |
| 1,825,026 | A | 9/1931 | Thomas |
| 1,830,625 | A | 11/1931 | Schrock |
| 1,842,638 | A | 1/1932 | Wigle |
| 1,880,218 | A | 10/1932 | Simmons |
| 1,917,135 | A | 7/1933 | Littell |
| 1,981,525 | A | 11/1934 | Price |
| 1,996,833 | A | 4/1935 | Crowell |
| 2,017,451 | A | 10/1935 | Wickersham |
| 2,049,450 | A | 8/1936 | Johnson |
| 2,060,352 | A | 11/1936 | Stokes |
| 2,105,885 | A | 1/1938 | Hinderflier |

(Continued)

FOREIGN PATENT DOCUMENTS

| | | |
|---|---|---|
| CA | 2 335 192 | 11/2001 |

(Continued)

OTHER PUBLICATIONS

Detlef Hahn, Friedhelm Makohl, and Larry Watkins, Casing-While Drilling System Reduces Hole Collapse Risks, Offshore, pp. 54, 56, and 59, Feb. 1998.

(Continued)

*Primary Examiner*—William Neuder
(74) *Attorney, Agent, or Firm*—Patterson & Sheridan LLP

(57) ABSTRACT

A method of drilling and lining a bore in an earth formation comprises providing a tubular outer elongate member and an inner elongate member located within the outer member. At least one of the members is spoolable. A drill bit is mounted to one of the members and a bore is drilled by advancing the drill bit through the earth formation and advancing the members through the bore.

108 Claims, 9 Drawing Sheets

U.S. PATENT DOCUMENTS

| | | | | |
|---|---|---|---|---|
| 2,167,338 | A | | 7/1939 | Murcell |
| 2,214,429 | A | | 9/1940 | Miller |
| 2,216,895 | A | | 10/1940 | Stokes |
| 2,228,503 | A | | 1/1941 | Boyd et al. |
| 2,295,803 | A | | 9/1942 | O'Leary |
| 2,305,062 | A | | 12/1942 | Church et al. |
| 2,324,679 | A | | 7/1943 | Cox |
| 2,370,832 | A | | 3/1945 | Baker |
| 2,379,800 | A | | 7/1945 | Hare |
| 2,414,719 | A | | 1/1947 | Cloud |
| 2,499,630 | A | | 3/1950 | Clark |
| 2,522,444 | A | | 9/1950 | Grable |
| 2,536,458 | A | | 1/1951 | Munsinger |
| 2,610,690 | A | | 9/1952 | Beatty |
| 2,621,742 | A | | 12/1952 | Brown |
| 2,627,891 | A | | 2/1953 | Clark |
| 2,641,444 | A | | 6/1953 | Moon |
| 2,650,314 | A | | 8/1953 | Hennigh et al. |
| 2,663,073 | A | | 12/1953 | Bieber et al. |
| 2,668,689 | A | | 2/1954 | Cormany |
| 2,692,059 | A | | 10/1954 | Bolling, Jr. |
| 2,720,267 | A | | 10/1955 | Brown |
| 2,738,011 | A | | 3/1956 | Mabry |
| 2,741,907 | A | | 4/1956 | Genender et al. |
| 2,743,087 | A | | 4/1956 | Layne et al. |
| 2,743,495 | A | | 5/1956 | Eklund |
| 2,764,329 | A | | 9/1956 | Hampton |
| 2,765,146 | A | | 10/1956 | Williams |
| 2,805,043 | A | | 9/1957 | Williams |
| 2,953,406 | A | | 9/1960 | Young |
| 2,978,047 | A | | 4/1961 | DeVaan |
| 3,006,415 | A | | 10/1961 | Burns et al. |
| 3,041,901 | A | | 7/1962 | Knights |
| 3,054,100 | A | | 9/1962 | Jones |
| 3,087,546 | A | | 4/1963 | Wooley |
| 3,090,031 | A | | 5/1963 | Lord |
| 3,102,599 | A | | 9/1963 | Hillburn |
| 3,111,179 | A | | 11/1963 | Albers et al. |
| 3,117,636 | A | | 1/1964 | Wilcox et al. |
| 3,122,811 | A | | 3/1964 | Gilreath |
| 3,123,160 | A | | 3/1964 | Kammerer |
| 3,124,023 | A | | 3/1964 | Marquis et al. |
| 3,131,769 | A | | 5/1964 | Rochemont |
| 3,159,219 | A | | 12/1964 | Scott |
| 3,169,592 | A | | 2/1965 | Kammerer |
| 3,191,677 | A | | 6/1965 | Kinley |
| 3,191,680 | A | | 6/1965 | Vincent |
| 3,193,116 | A | | 7/1965 | Kenneday et al. |
| 3,353,599 | A | | 11/1967 | Swift |
| 3,380,528 | A | | 4/1968 | Timmons |
| 3,387,893 | A | | 6/1968 | Hoever |
| 3,392,609 | A | | 7/1968 | Bartos |
| 3,419,079 | A | | 12/1968 | Current |
| 3,477,527 | A | | 11/1969 | Koot |
| 3,489,220 | A | | 1/1970 | Kinley |
| 3,518,903 | A | | 7/1970 | Ham et al. |
| 3,548,936 | A | | 12/1970 | Kilgore et al. |
| 3,550,684 | A | | 12/1970 | Cubberly, Jr. |
| 3,552,507 | A | | 1/1971 | Brown |
| 3,552,508 | A | * | 1/1971 | Brown ..... 175/258 |
| 3,552,509 | A | | 1/1971 | Brown |
| 3,552,510 | A | | 1/1971 | Brown |
| 3,552,848 | A | | 1/1971 | Van Wagner |
| 3,559,739 | A | | 2/1971 | Hutchison |
| 3,566,505 | A | | 3/1971 | Martin |
| 3,570,598 | A | | 3/1971 | Johnson |
| 3,575,245 | A | | 4/1971 | Cordary et al. |
| 3,602,302 | A | | 8/1971 | Kluth |
| 3,603,411 | A | | 9/1971 | Link |
| 3,603,412 | A | | 9/1971 | Kammerer, Jr. et al. |
| 3,603,413 | A | | 9/1971 | Grill et al. |
| 3,606,664 | A | | 9/1971 | Weiner |
| 3,624,760 | A | | 11/1971 | Bodine |
| 3,635,105 | A | | 1/1972 | Dickmann et al. |
| 3,656,564 | A | | 4/1972 | Brown |
| 3,662,842 | A | | 5/1972 | Bromell |
| 3,669,190 | A | | 6/1972 | Sizer et al. |
| 3,680,412 | A | | 8/1972 | Mayer et al. |
| 3,691,624 | A | | 9/1972 | Kinley |
| 3,691,825 | A | | 9/1972 | Dyer |
| 3,692,126 | A | | 9/1972 | Rushing et al. |
| 3,696,332 | A | | 10/1972 | Dickson, Jr. et al. |
| 3,700,048 | A | | 10/1972 | Desmoulins |
| 3,729,057 | A | | 4/1973 | Werner |
| 3,747,675 | A | | 7/1973 | Brown |
| 3,748,330 | A | | 7/1973 | Tecluk |
| 3,760,894 | A | | 9/1973 | Pitifer |
| 3,776,320 | A | | 12/1973 | Brown |
| 3,776,991 | A | | 12/1973 | Marcus |
| 3,785,193 | A | | 1/1974 | Kinley et al. |
| 3,808,916 | A | | 5/1974 | Porter et al. |
| 3,838,613 | A | | 10/1974 | Wilms |
| 3,840,128 | A | | 10/1974 | Swoboda, Jr. et al. |
| 3,848,684 | A | | 11/1974 | West |
| 3,857,450 | A | | 12/1974 | Guier |
| 3,870,114 | A | | 3/1975 | Pulk et al. |
| 3,881,375 | A | | 5/1975 | Kelly |
| 3,885,679 | A | | 5/1975 | Swoboda, Jr. et al. |
| 3,901,331 | A | | 8/1975 | Djurovic |
| 3,913,687 | A | | 10/1975 | Gyongyosi et al. |
| 3,915,244 | A | | 10/1975 | Brown |
| 3,934,660 | A | | 1/1976 | Nelson |
| 3,945,444 | A | | 3/1976 | Knudson |
| 3,947,009 | A | | 3/1976 | Nelmark |
| 3,964,556 | A | | 6/1976 | Gearhart et al. |
| 3,980,143 | A | | 9/1976 | Swartz et al. |
| 4,049,066 | A | | 9/1977 | Richey |
| 4,054,332 | A | | 10/1977 | Bryan, Jr. |
| 4,054,426 | A | | 10/1977 | White |
| 4,064,939 | A | | 12/1977 | Marquis |
| 4,077,525 | A | | 3/1978 | Callegari et al. |
| 4,082,144 | A | | 4/1978 | Marquis |
| 4,083,405 | A | | 4/1978 | Shirley |
| 4,085,808 | A | | 4/1978 | Kling |
| 4,095,865 | A | | 6/1978 | Denison et al. |
| 4,100,968 | A | | 7/1978 | Delano |
| 4,100,981 | A | | 7/1978 | Chaffin |
| 4,127,927 | A | | 12/1978 | Hauk et al. |
| 4,133,396 | A | | 1/1979 | Tschirky |
| 4,142,739 | A | | 3/1979 | Billingsley |
| 4,173,457 | A | | 11/1979 | Smith |
| 4,175,619 | A | | 11/1979 | Davis |
| 4,186,628 | A | | 2/1980 | Bonnice |
| 4,189,185 | A | | 2/1980 | Kammerer, Jr. et al. |
| 4,194,383 | A | | 3/1980 | Huzyak |
| 4,221,269 | A | | 9/1980 | Hudson |
| 4,227,197 | A | | 10/1980 | Nimmo et al. |
| 4,241,878 | A | | 12/1980 | Underwood |
| 4,257,442 | A | | 3/1981 | Claycomb |
| 4,262,693 | A | | 4/1981 | Giebeler |
| 4,274,777 | A | | 6/1981 | Scaggs |
| 4,274,778 | A | | 6/1981 | Putnam et al. |
| 4,277,197 | A | | 7/1981 | Bingham |
| 4,280,380 | A | | 7/1981 | Eshghy |
| 4,281,722 | A | | 8/1981 | Tucker et al. |
| 4,287,949 | A | | 9/1981 | Lindsey, Jr. |
| 4,311,195 | A | | 1/1982 | Mullins, II |
| 4,315,553 | A | | 2/1982 | Stallings |
| 4,320,915 | A | | 3/1982 | Abbott et al. |
| 4,336,415 | A | | 6/1982 | Walling |
| 4,384,627 | A | | 5/1983 | Ramirez-Jauregui |
| 4,392,534 | A | | 7/1983 | Miida |
| 4,396,076 | A | | 8/1983 | Inoue |
| 4,396,077 | A | | 8/1983 | Radtke |

4,407,378 A 10/1983 Thomas
4,408,669 A 10/1983 Wiredal
4,413,682 A 11/1983 Callihan et al.
4,427,063 A 1/1984 Skinner
4,437,363 A 3/1984 Haynes
4,440,220 A 4/1984 McArthur
4,445,734 A 5/1984 Cunningham
4,446,745 A 5/1984 Stone et al.
4,449,596 A 5/1984 Boyadjieff
4,460,053 A 7/1984 Jurgens et al.
4,463,814 A 8/1984 Horstmeyer et al.
4,466,498 A 8/1984 Bardwell
4,470,470 A 9/1984 Takano
4,472,002 A 9/1984 Beney et al.
4,474,243 A 10/1984 Gaines
4,483,399 A 11/1984 Colgate
4,489,793 A 12/1984 Boren
4,489,794 A 12/1984 Boyadjieff
4,492,134 A 1/1985 Reinholdt et al.
4,494,424 A 1/1985 Bates
4,515,045 A 5/1985 Gnatchenko et al.
4,529,045 A 7/1985 Boyadjieff et al.
4,544,041 A 10/1985 Rinaldi
4,545,443 A 10/1985 Wiredal
4,570,706 A 2/1986 Pugnet
4,580,631 A 4/1986 Baugh
4,583,603 A 4/1986 Dorleans et al.
4,589,495 A 5/1986 Langer et al.
4,592,125 A 6/1986 Skene
4,593,773 A 6/1986 Skeie
4,595,058 A 6/1986 Nations
4,604,724 A 8/1986 Shaginian et al.
4,604,818 A 8/1986 Inoue
4,605,077 A 8/1986 Boyadjieff
4,605,268 A 8/1986 Meador
4,620,600 A 11/1986 Persson
4,625,796 A 12/1986 Boyadjieff
4,630,691 A 12/1986 Hooper
4,646,827 A 3/1987 Cobb
4,649,777 A 3/1987 Buck
4,651,837 A 3/1987 Mayfield
4,652,195 A 3/1987 McArthur
4,655,286 A 4/1987 Wood
4,667,752 A 5/1987 Berry et al.
4,671,358 A 6/1987 Lindsey, Jr. et al.
4,676,310 A 6/1987 Scherbatskoy et al.
4,676,312 A 6/1987 Mosing et al.
4,678,031 A 7/1987 Blandford et al.
4,681,158 A 7/1987 Pennison
4,681,162 A 7/1987 Boyd
4,683,962 A 8/1987 True
4,686,873 A 8/1987 Lang et al.
4,691,587 A 9/1987 Farrand et al.
4,693,316 A 9/1987 Ringgenberg et al.
4,699,224 A 10/1987 Burton
4,709,599 A 12/1987 Buck
4,709,766 A 12/1987 Boyadjieff
4,725,179 A 2/1988 Woolslayer et al.
4,735,270 A 4/1988 Fenyvesi
4,738,145 A 4/1988 Vincent et al.
4,742,876 A 5/1988 Barthelemy et al.
4,744,426 A 5/1988 Reed
4,759,239 A 7/1988 Hamilton et al.
4,760,882 A 8/1988 Novak
4,762,187 A 8/1988 Haney
4,765,401 A 8/1988 Boyadjieff
4,765,416 A 8/1988 Bjerking et al.
4,773,689 A 9/1988 Wolters
4,775,009 A 10/1988 Wittrisch et al.
4,778,008 A 10/1988 Gonzalez et al.
4,781,359 A 11/1988 Matus
4,788,544 A 11/1988 Howard
4,791,997 A 12/1988 Krasnov
4,793,422 A 12/1988 Krasnov
4,800,968 A 1/1989 Shaw et al.
4,806,928 A 2/1989 Veneruso
4,813,493 A 3/1989 Shaw et al.
4,813,495 A 3/1989 Leach
4,821,814 A 4/1989 Willis et al.
4,825,947 A 5/1989 Mikolajczyk
4,832,552 A 5/1989 Skelly
4,836,064 A 6/1989 Slator
4,836,299 A 6/1989 Bodine
4,842,081 A 6/1989 Parant
4,843,945 A 7/1989 Dinsdale
4,848,469 A 7/1989 Baugh et al.
4,854,386 A 8/1989 Baker et al.
4,867,236 A 9/1989 Haney et al.
4,878,546 A 11/1989 Shaw et al.
4,880,058 A 11/1989 Lindsey et al.
4,883,125 A 11/1989 Wilson et al.
4,901,069 A 2/1990 Veneruso
4,904,119 A 2/1990 Legendre et al.
4,909,741 A 3/1990 Schasteen et al.
4,915,181 A * 4/1990 Labrosse ..... 175/263
4,921,386 A 5/1990 McArthur
4,936,382 A 6/1990 Thomas
4,960,173 A 10/1990 Cognevich et al.
4,962,579 A 10/1990 Moyer et al.
4,962,819 A 10/1990 Bailey et al.
4,962,822 A * 10/1990 Pascale ..... 175/258
4,997,042 A 3/1991 Jordan et al.
5,009,265 A 4/1991 Bailey et al.
5,022,472 A 6/1991 Bailey et al.
5,027,914 A 7/1991 Wilson
5,036,927 A 8/1991 Willis
5,049,020 A 9/1991 McArthur
5,052,483 A 10/1991 Hudson
5,060,542 A 10/1991 Hauk
5,060,737 A 10/1991 Mohn
5,062,756 A 11/1991 McArthur et al.
5,069,297 A 12/1991 Krueger
5,074,366 A 12/1991 Karlsson et al.
5,082,069 A 1/1992 Seiler et al.
5,085,273 A 2/1992 Coone
5,096,465 A 3/1992 Chen et al.
5,109,924 A 5/1992 Jurgens et al.
5,111,893 A 5/1992 Kvello-Aune
5,141,063 A 8/1992 Quesenbury
RE34,063 E 9/1992 Vincent et al.
5,148,875 A 9/1992 Karlsson et al.
5,156,213 A 10/1992 George et al.
5,160,925 A 11/1992 Dailey et al.
5,168,942 A 12/1992 Wydrinski
5,172,765 A 12/1992 Sas-Jaworsky
5,176,518 A 1/1993 Hordijk et al.
5,181,571 A 1/1993 Mueller
5,186,265 A 2/1993 Henson et al.
5,191,932 A 3/1993 Seefried et al.
5,191,939 A 3/1993 Stokley
5,197,553 A 3/1993 Leturno
5,224,540 A 7/1993 Streich et al.
5,233,742 A 8/1993 Gray et al.
5,234,052 A 8/1993 Coone et al.
5,245,265 A 9/1993 Clay
5,251,709 A 10/1993 Richardson
5,255,741 A 10/1993 Alexander
5,255,751 A 10/1993 Stogner
5,271,468 A 12/1993 Streich et al.
5,271,472 A 12/1993 Leturno
5,272,925 A 12/1993 Henneuse et al.
5,282,653 A 2/1994 LaFleur et al.
5,284,210 A 2/1994 Helms et al.
5,285,008 A 2/1994 Sas-Jaworsky et al.
5,285,204 A 2/1994 Sas-Jaworsky
5,291,956 A 3/1994 Mueller et al.

5,294,228 A 3/1994 Willis et al.
5,297,833 A 3/1994 Willis et al.
5,305,830 A 4/1994 Wittrisch
5,305,839 A 4/1994 Kalsi et al.
5,318,122 A 6/1994 Murray et al.
5,320,178 A 6/1994 Cornette
5,322,127 A 6/1994 McNair et al.
5,323,858 A 6/1994 Jones et al.
5,332,043 A 7/1994 Ferguson
5,332,048 A 7/1994 Underwood et al.
5,340,182 A 8/1994 Busink et al.
5,343,950 A 9/1994 Hale et al.
5,343,951 A 9/1994 Cowan et al.
5,348,095 A 9/1994 Worrall et al.
5,351,767 A 10/1994 Stogner et al.
5,353,872 A 10/1994 Wittrisch
5,354,150 A 10/1994 Canales
5,355,967 A 10/1994 Mueller et al.
5,361,859 A 11/1994 Tibbitts
5,368,113 A 11/1994 Schulze-Beckinghausen
5,375,668 A 12/1994 Hallundbaek
5,379,835 A 1/1995 Streich
5,386,746 A 2/1995 Hauk
5,388,651 A 2/1995 Berry
5,392,715 A 2/1995 Pelrine
5,394,823 A 3/1995 Lenze
5,402,856 A 4/1995 Warren et al.
5,433,279 A 7/1995 Tessari et al.
5,435,400 A 7/1995 Smith
5,452,923 A 9/1995 Smith
5,456,317 A 10/1995 Hood, III et al.
5,458,209 A 10/1995 Hayes et al.
5,461,905 A 10/1995 Penisson
5,472,057 A 12/1995 Winfree
5,477,925 A 12/1995 Trahan et al.
5,494,122 A 2/1996 Larsen et al.
5,497,840 A 3/1996 Hudson
5,501,286 A 3/1996 Berry
5,503,234 A 4/1996 Clanton
5,520,255 A 5/1996 Barr et al.
5,526,880 A 6/1996 Jordan, Jr. et al.
5,535,824 A 7/1996 Hudson
5,535,838 A 7/1996 Keshavan et al.
5,540,279 A 7/1996 Branch et al.
5,542,472 A 8/1996 Pringle et al.
5,542,473 A 8/1996 Pringle et al.
5,547,029 A 8/1996 Rubbo et al.
5,551,521 A 9/1996 Vail, III
5,553,672 A 9/1996 Smith, Jr. et al.
5,553,679 A 9/1996 Thorp
5,560,437 A 10/1996 Dickel et al.
5,560,440 A 10/1996 Tibbitts
5,566,772 A 10/1996 Coone et al.
5,575,344 A 11/1996 Wireman
5,577,566 A 11/1996 Albright et al.
5,582,259 A 12/1996 Barr
5,584,343 A 12/1996 Coone
5,588,916 A 12/1996 Moore
5,613,567 A 3/1997 Hudson
5,615,747 A 4/1997 Vail, III
5,645,131 A 7/1997 Trevisani
5,651,420 A 7/1997 Tibbitts et al.
5,661,888 A 9/1997 Hanslik
5,662,170 A 9/1997 Donovan et al.
5,662,182 A 9/1997 McLeod et al.
5,667,011 A 9/1997 Gill et al.
5,667,023 A 9/1997 Harrell et al.
5,667,026 A 9/1997 Lorenz et al.
5,697,442 A 12/1997 Baldridge
5,706,894 A 1/1998 Hawkins, III
5,706,905 A 1/1998 Barr
5,711,382 A 1/1998 Hansen et al.
5,717,334 A 2/1998 Vail, III et al.
5,720,356 A 2/1998 Gardes
5,730,471 A 3/1998 Schulze-Beckinghausen et al.
5,732,776 A 3/1998 Tubel et al.
5,735,348 A 4/1998 Hawkins, III
5,735,351 A 4/1998 Helms
5,743,344 A 4/1998 McLeod et al.
5,746,276 A 5/1998 Stuart
5,772,514 A 6/1998 Moore
5,785,132 A 7/1998 Richardson et al.
5,785,134 A 7/1998 McLeod et al.
5,787,978 A 8/1998 Carter et al.
5,791,410 A 8/1998 Castille et al.
5,794,703 A 8/1998 Newman et al.
5,803,191 A 9/1998 Mackintosh
5,803,666 A 9/1998 Keller
5,813,456 A 9/1998 Milner et al.
5,823,264 A 10/1998 Ringgenberg
5,826,651 A 10/1998 Lee et al.
5,828,003 A 10/1998 Thomeer et al.
5,829,520 A 11/1998 Johnson
5,833,002 A 11/1998 Holcombe
5,836,395 A 11/1998 Budde
5,836,409 A 11/1998 Vail, III
5,839,330 A 11/1998 Stokka
5,839,515 A 11/1998 Yuan et al.
5,839,519 A 11/1998 Spedale, Jr.
5,842,149 A 11/1998 Harrell et al.
5,842,530 A 12/1998 Smith et al.
5,845,722 A 12/1998 Makohl et al.
5,850,877 A 12/1998 Albright et al.
5,860,474 A 1/1999 Stoltz et al.
5,878,815 A 3/1999 Collins
5,887,655 A 3/1999 Haugen et al.
5,887,668 A 3/1999 Haugen et al.
5,890,537 A 4/1999 Lavaure et al.
5,890,549 A 4/1999 Sprehe
5,894,897 A 4/1999 Vail, III
5,907,664 A 5/1999 Wang et al.
5,908,049 A 6/1999 Williams et al.
5,909,768 A 6/1999 Castille et al.
5,913,337 A 6/1999 Williams et al.
5,921,285 A 7/1999 Quigley et al.
5,921,332 A 7/1999 Spedale, Jr.
5,931,231 A 8/1999 Mock
5,947,213 A 9/1999 Angle et al.
5,950,742 A 9/1999 Caraway
5,954,131 A 9/1999 Sallwasser
5,957,225 A 9/1999 Sinor
5,960,881 A 10/1999 Allamon et al.
5,971,079 A 10/1999 Mullins
5,971,086 A 10/1999 Bee et al.
5,984,007 A 11/1999 Yuan et al.
5,988,273 A 11/1999 Monjure et al.
6,000,472 A 12/1999 Albright et al.
6,012,529 A 1/2000 Mikolajczyk et al.
6,024,169 A 2/2000 Haugen
6,026,911 A 2/2000 Angle et al.
6,035,953 A 3/2000 Rear
6,056,060 A 5/2000 Abrahamsen et al.
6,059,051 A 5/2000 Jewkes et al.
6,059,053 A 5/2000 McLeod
6,061,000 A 5/2000 Edwards
6,062,326 A 5/2000 Strong et al.
6,065,550 A 5/2000 Gardes
6,070,500 A 6/2000 Dlask et al.
6,070,671 A 6/2000 Cumming et al.
6,079,498 A 6/2000 Lima et al.
6,079,509 A 6/2000 Bee et al.
6,082,461 A 7/2000 Newman et al.
6,089,323 A 7/2000 Newman et al.
6,098,717 A 8/2000 Bailey et al.
6,119,772 A 9/2000 Pruet
6,135,208 A 10/2000 Gano et al.

6,142,545 A 11/2000 Penman et al.
6,155,360 A 12/2000 McLeod
6,158,531 A 12/2000 Vail, III
6,161,617 A 12/2000 Gjedebo
6,170,573 B1 1/2001 Brunet et al.
6,172,010 B1 1/2001 Argillier et al.
6,173,777 B1 1/2001 Mullins
6,179,055 B1 1/2001 Sallwasser et al.
6,182,776 B1 2/2001 Asberg
6,186,233 B1 2/2001 Brunet
6,189,616 B1 2/2001 Gano et al.
6,189,621 B1 2/2001 Vail, III
6,196,336 B1 3/2001 Fincher et al.
6,199,641 B1 3/2001 Downie et al.
6,202,764 B1 3/2001 Ables et al.
6,206,112 B1 3/2001 Dickinson, III et al.
6,216,533 B1 4/2001 Woloson et al.
6,217,258 B1 4/2001 Yamamoto et al.
6,220,117 B1 4/2001 Butcher
6,223,823 B1 5/2001 Head
6,227,587 B1 5/2001 Terral
6,234,257 B1 5/2001 Ciglenec et al.
6,237,684 B1 5/2001 Bouligny, Jr. et al.
6,263,987 B1 7/2001 Vail, III
6,273,189 B1 8/2001 Gissler et al.
6,275,938 B1 8/2001 Bond et al.
6,290,432 B1 9/2001 Exley et al.
6,296,066 B1 10/2001 Terry et al.
6,305,469 B1 10/2001 Coenen et al.
6,309,002 B1 10/2001 Bouligny
6,311,792 B1 11/2001 Scott et al.
6,315,051 B1 11/2001 Ayling
6,325,148 B1 12/2001 Trahan et al.
6,343,649 B1 2/2002 Beck et al.
6,347,674 B1 2/2002 Bloom et al.
6,349,764 B1 2/2002 Adams et al.
6,357,485 B1 3/2002 Quigley et al.
6,359,569 B1 3/2002 Beck et al.
6,360,633 B1 3/2002 Pietras
6,367,552 B1 4/2002 Scott et al.
6,367,566 B1 * 4/2002 Hill ..... 175/57
6,371,203 B1 4/2002 Frank et al.
6,374,506 B1 4/2002 Schutte et al.
6,374,924 B1 4/2002 Hanton et al.
6,378,627 B1 4/2002 Tubel et al.
6,378,630 B1 4/2002 Ritorto et al.
6,378,633 B1 4/2002 Moore
6,390,190 B1 5/2002 Mullins
6,392,317 B1 5/2002 Hall et al.
6,397,946 B1 6/2002 Vail, III
6,405,798 B1 6/2002 Barrett et al.
6,408,943 B1 6/2002 Schultz et al.
6,412,554 B1 7/2002 Allen et al.
6,412,574 B1 7/2002 Wardley et al.
6,419,014 B1 7/2002 Meek et al.
6,419,033 B1 7/2002 Hahn et al.
6,427,776 B1 8/2002 Hoffman et al.
6,429,784 B1 8/2002 Beique et al.
6,431,626 B1 8/2002 Bouligny
6,439,618 B1 * 8/2002 Beeman et al. ..... 285/323
6,443,241 B1 9/2002 Juhasz et al.
6,443,247 B1 9/2002 Wardley
6,446,723 B1 9/2002 Ramons et al.
6,457,532 B1 10/2002 Simpson
6,458,471 B1 10/2002 Lovato et al.
6,464,004 B1 10/2002 Crawford et al.
6,464,011 B1 10/2002 Tubel
6,484,818 B1 11/2002 Alft et al.
6,497,280 B1 12/2002 Beck et al.
6,527,047 B1 3/2003 Pietras
6,527,064 B1 3/2003 Hallundbaek
6,527,493 B1 3/2003 Kamphorst et al.
6,536,520 B1 3/2003 Snider et al.
6,536,522 B1 3/2003 Birckhead et al.
6,536,993 B1 3/2003 Strong et al.
6,538,576 B1 3/2003 Schultz et al.
6,540,025 B1 4/2003 Scott et al.
6,543,552 B1 4/2003 Metcalfe et al.
6,547,017 B1 4/2003 Vail, III
6,553,825 B1 4/2003 Boyd
6,554,064 B1 4/2003 Restarick et al.
6,585,040 B1 7/2003 Hanton et al.
6,591,471 B1 7/2003 Hollingsworth et al.
6,595,288 B1 7/2003 Mosing et al.
6,619,402 B1 9/2003 Amory et al.
6,622,796 B1 9/2003 Pietras
6,634,430 B1 10/2003 Dawson et al.
6,637,526 B1 10/2003 Juhasz et al.
6,648,075 B1 11/2003 Badrak et al.
6,651,737 B1 11/2003 Bouligny
6,655,460 B1 12/2003 Bailey et al.
6,666,274 B1 12/2003 Hughes
6,668,684 B1 12/2003 Allen et al.
6,668,937 B1 12/2003 Murray
6,679,333 B1 1/2004 York et al.
6,688,394 B1 2/2004 Ayling
6,688,398 B1 2/2004 Pietras
6,691,801 B1 2/2004 Juhasz et al.
6,698,595 B1 3/2004 Norell et al.
6,702,040 B1 3/2004 Sensenig
6,708,769 B1 3/2004 Haugen et al.
6,715,430 B1 4/2004 Choi et al.
6,719,071 B1 4/2004 Moyes
6,725,924 B1 4/2004 Davidson et al.
6,725,938 B1 4/2004 Pietras
6,732,822 B1 5/2004 Slack et al.
6,742,584 B1 6/2004 Appleton
6,742,596 B1 6/2004 Haugen
6,742,606 B1 6/2004 Metcalfe et al.
6,745,834 B1 6/2004 Davis et al.
6,752,211 B1 6/2004 Dewey et al.
6,832,658 B1 12/2004 Keast
6,837,313 B1 1/2005 Hosie et al.
6,840,322 B1 1/2005 Haynes
6,848,517 B1 2/2005 Wardley
6,854,533 B1 2/2005 Galloway
6,857,486 B1 2/2005 Chitwood et al.
6,857,487 B1 2/2005 Galloway et al.
2001/0000101 A1 4/2001 Lovato et al.
2001/0002626 A1 6/2001 Frank et al.
2001/0013412 A1 8/2001 Tubel
2001/0040054 A1 11/2001 Haugen et al.
2001/0042625 A1 11/2001 Appleton
2001/0047883 A1 12/2001 Hanton et al.
2002/0040787 A1 4/2002 Cook et al.
2002/0066556 A1 6/2002 Goode et al.
2002/0074127 A1 6/2002 Birckhead et al.
2002/0074132 A1 6/2002 Juhasz et al.
2002/0079102 A1 6/2002 Dewey et al.
2002/0108748 A1 8/2002 Keyes
2002/0134555 A1 9/2002 Allen et al.
2002/0157829 A1 10/2002 Davis et al.
2002/0162690 A1 11/2002 Hanton et al.
2002/0170720 A1 11/2002 Haugen
2002/0189806 A1 12/2002 Davidson et al.
2002/0189863 A1 12/2002 Wardley
2003/0029641 A1 2/2003 Meehan
2003/0034177 A1 2/2003 Chitwood et al.
2003/0056947 A1 3/2003 Cameron
2003/0056991 A1 3/2003 Hahn et al.
2003/0070841 A1 4/2003 Merecka et al.
2003/0070842 A1 4/2003 Bailey et al.
2003/0111267 A1 6/2003 Pia
2003/0132032 A1 * 7/2003 Metcalfe et al. ..... 175/57
2003/0141111 A1 7/2003 Pia
2003/0146023 A1 8/2003 Pia

| | | | | |
|---|---|---|---|---|
| 2003/0164250 | A1 | 9/2003 | Wardley | |
| 2003/0164251 | A1 | 9/2003 | Tulloch | |
| 2003/0164276 | A1 | 9/2003 | Snider et al. | |
| 2003/0173073 | A1 | 9/2003 | Snider et al. | |
| 2003/0173090 | A1* | 9/2003 | Cook et al. | 166/382 |
| 2003/0213598 | A1 | 11/2003 | Hughes | |
| 2003/0217865 | A1 | 11/2003 | Simpson et al. | |
| 2003/0221519 | A1 | 12/2003 | Haugen | |
| 2004/0000405 | A1 | 1/2004 | Fournier, Jr. et al. | |
| 2004/0003490 | A1 | 1/2004 | Shahin et al. | |
| 2004/0003944 | A1 | 1/2004 | Vincent et al. | |
| 2004/0011534 | A1 | 1/2004 | Simonds et al. | |
| 2004/0016575 | A1 | 1/2004 | Shahin et al. | |
| 2004/0060697 | A1 | 4/2004 | Tilton et al. | |
| 2004/0069500 | A1 | 4/2004 | Haugen | |
| 2004/0069501 | A1 | 4/2004 | Haugen et al. | |
| 2004/0079533 | A1 | 4/2004 | Buytaert et al. | |
| 2004/0108142 | A1 | 6/2004 | Vail, III | |
| 2004/0112603 | A1 | 6/2004 | Galloway et al. | |
| 2004/0112646 | A1 | 6/2004 | Vail | |
| 2004/0118613 | A1 | 6/2004 | Vail | |
| 2004/0118614 | A1 | 6/2004 | Galloway et al. | |
| 2004/0123984 | A1 | 7/2004 | Vail | |
| 2004/0124010 | A1 | 7/2004 | Galloway et al. | |
| 2004/0124011 | A1 | 7/2004 | Gledhill et al. | |
| 2004/0124015 | A1 | 7/2004 | Vaile et al. | |
| 2004/0129456 | A1* | 7/2004 | Vail, III | 175/57 |
| 2004/0140128 | A1 | 7/2004 | Vail | |
| 2004/0144547 | A1 | 7/2004 | Koithan et al. | |
| 2004/0173358 | A1 | 9/2004 | Haugen | |
| 2004/0216892 | A1 | 11/2004 | Giroux et al. | |
| 2004/0216924 | A1 | 11/2004 | Pietras et al. | |
| 2004/0216925 | A1 | 11/2004 | Metcalfe et al. | |
| 2004/0221997 | A1 | 11/2004 | Giroux et al. | |
| 2004/0226751 | A1 | 11/2004 | McKay et al. | |
| 2004/0244992 | A1 | 12/2004 | Carter et al. | |
| 2004/0245020 | A1 | 12/2004 | Giroux et al. | |
| 2004/0251025 | A1 | 12/2004 | Giroux et al. | |
| 2004/0251050 | A1 | 12/2004 | Shahin et al. | |
| 2004/0251055 | A1 | 12/2004 | Shahin et al. | |
| 2004/0262013 | A1 | 12/2004 | Tilton et al. | |
| 2005/0000691 | A1 | 1/2005 | Giroux et al. | |
| 2005/0096846 | A1 | 5/2005 | Koithan et al. | |

FOREIGN PATENT DOCUMENTS

| | | |
|---|---|---|
| DE | 3 213 464 | 10/1983 |
| DE | 3 523 221 | 2/1987 |
| DE | 3 918 132 | 12/1989 |
| DE | 4 133 802 | 10/1992 |
| EP | 0 087 373 | 8/1983 |
| EP | 0 162 000 | 11/1985 |
| EP | 0 171 144 | 2/1986 |
| EP | 0 235 105 | 9/1987 |
| EP | 0 265 344 | 4/1988 |
| EP | 0 285 386 | 10/1988 |
| EP | 0 426 123 | 5/1991 |
| EP | 0 462 618 | 12/1991 |
| EP | 0 474 481 | 3/1992 |
| EP | 0479583 | 4/1992 |
| EP | 0 525 247 | 2/1993 |
| EP | 0 554 568 | 8/1993 |
| EP | 0 589 823 | 3/1994 |
| EP | 0 659 975 | 6/1995 |
| EP | 0 790 386 | 8/1997 |
| EP | 0 881 354 | 4/1998 |
| EP | 0 571 045 | 8/1998 |
| EP | 0 961 007 | 12/1999 |
| EP | 0 962 384 | 12/1999 |
| EP | 1 006 260 | 6/2000 |
| EP | 1 050 661 | 11/2000 |
| EP | 1148206 | 10/2001 |
| EP | 1 256 691 | 11/2002 |
| FR | 2053088 | 7/1970 |
| FR | 2741907 | 6/1997 |
| FR | 2 841 293 | 12/2003 |
| GB | 540 027 | 10/1941 |
| GB | 709 365 | 5/1954 |
| GB | 716 761 | 10/1954 |
| GB | 7 928 86 | 4/1958 |
| GB | 8 388 33 | 6/1960 |
| GB | 881 358 | 11/1961 |
| GB | 9 977 21 | 7/1965 |
| GB | 1 277 461 | 6/1972 |
| GB | 1 306 588 | 3/1973 |
| GB | 1 448 304 | 9/1976 |
| GB | 1 469 661 | 4/1977 |
| GB | 1 582 392 | 1/1981 |
| GB | 2 053 088 | 2/1981 |
| GB | 2 115 940 | 9/1983 |
| GB | 2 170 528 | 6/1986 |
| GB | 2 201 912 | 9/1988 |
| GB | 2 216 926 | 10/1989 |
| GB | 2 223 253 | 4/1990 |
| GB | 2 224 481 | 9/1990 |
| GB | 2 240 799 | 6/1991 |
| GB | 2 275 486 | 4/1993 |
| GB | 2 294 715 | 8/1996 |
| GB | 2 313 860 | 2/1997 |
| GB | 2 320 270 | 6/1998 |
| GB | 2 324 108 | 10/1998 |
| GB | 2 333 542 | 7/1999 |
| GB | 2 335 217 | 9/1999 |
| GB | 2 345 074 | 6/2000 |
| GB | 2 348 223 | 9/2000 |
| GB | 2347445 | 9/2000 |
| GB | 2 349 401 | 11/2000 |
| GB | 2 350 137 | 11/2000 |
| GB | 2 357 101 | 6/2001 |
| GB | 2 357 530 | 6/2001 |
| GB | 2 352 747 | 7/2001 |
| GB | 2 365 463 | 2/2002 |
| GB | 2 372 271 | 8/2002 |
| GB | 2 372 765 | 9/2002 |
| GB | 2 382 361 | 5/2003 |
| GB | 2381809 | 5/2003 |
| GB | 2 386 626 | 9/2003 |
| GB | 2 389 130 | 12/2003 |
| RU | 2 079 633 | 5/1997 |
| SU | 112631 | 1/1956 |
| SU | 659260 | 4/1967 |
| SU | 247162 | 5/1967 |
| SU | 395557 | 12/1971 |
| SU | 415346 | 3/1972 |
| SU | 481689 | 6/1972 |
| SU | 461218 | 4/1973 |
| SU | 501139 | 12/1973 |
| SU | 585266 | 7/1974 |
| SU | 583278 | 8/1974 |
| SU | 601390 | 1/1976 |
| SU | 581238 | 2/1976 |
| SU | 655843 | 3/1977 |
| SU | 781312 | 3/1978 |
| SU | 899820 | 6/1979 |
| SU | 955765 | 2/1981 |
| SU | 1304470 | 8/1984 |
| SU | 1618870 | 1/1991 |
| SU | 1808972 | 5/1991 |
| WO | WO 90/06418 | 6/1990 |
| WO | WO 91/16520 | 10/1991 |
| WO | WO 92/01139 | 1/1992 |
| WO | WO 92/18743 | 10/1992 |
| WO | WO 92/20899 | 11/1992 |
| WO | WO 93/07358 | 4/1993 |
| WO | WO 93/24728 | 12/1993 |
| WO | WO 95/10686 | 4/1995 |

| | | |
|---|---|---|
| WO | WO 98/01651 | 1/1996 |
| WO | WO 96/18799 | 6/1996 |
| WO | WO 96/28635 | 9/1996 |
| WO | WO 97/05360 | 2/1997 |
| WO | WO 97/08418 | 3/1997 |
| WO | WO 98/05844 | 2/1998 |
| WO | WO 98/09053 | 3/1998 |
| WO | WO 98/11322 | 3/1998 |
| WO | WO 98/32948 | 7/1998 |
| WO | WO 98/55730 | 12/1998 |
| WO | WO 99/04135 | 1/1999 |
| WO | WO 99/11902 | 3/1999 |
| WO | WO 99/23354 | 5/1999 |
| WO | WO 99/24689 | 5/1999 |
| WO | WO 99/35368 | 7/1999 |
| WO | WO 99/37881 | 7/1999 |
| WO | WO 99/41485 | 8/1999 |
| WO | WO 99/50528 | 10/1999 |
| WO | WO 99/58810 | 11/1999 |
| WO | WO 99/64713 | 12/1999 |
| WO | WO 00/04259 | 1/2000 |
| WO | WO 00/05483 | 2/2000 |
| WO | WO 00/08293 | 2/2000 |
| WO | WO 00/09853 | 2/2000 |
| WO | WO 00/11309 | 3/2000 |
| WO | WO 00/11310 | 3/2000 |
| WO | WO 00/11311 | 3/2000 |
| WO | WO 00/28188 | 5/2000 |
| WO | WO 00/37766 | 6/2000 |
| WO | WO 00/37771 | 6/2000 |
| WO | WO 00/39429 | 7/2000 |
| WO | WO 00/39430 | 7/2000 |
| WO | WO 00/41487 | 7/2000 |
| WO | WO 00/46484 | 8/2000 |
| WO | WO 00/50730 | 8/2000 |
| WO | WO 00/66879 | 11/2000 |
| WO | WO 01/12946 | 2/2001 |
| WO | WO 01/46550 | 6/2001 |
| WO | WO 01/79650 | 10/2001 |
| WO | WO 01/81708 | 11/2001 |
| WO | WO 01/83932 | 11/2001 |
| WO | WO 01/94738 | 12/2001 |
| WO | WO 01/94739 | 12/2001 |
| WO | WO 02/14649 | 2/2002 |
| WO | WO 02/44601 | 6/2002 |
| WO | WO 02/081863 | 10/2002 |
| WO | WO 02/086287 | 10/2002 |
| WO | WO 03/006790 | 1/2003 |
| WO | WO 03/074836 | 9/2003 |
| WO | WO 03/087525 | 10/2003 |
| WO | WO 2004/022903 | 3/2004 |

OTHER PUBLICATIONS

Yakov A. Gelfgat, Mikhail Y. Gelfgat and Yuri S. Lopatin, Retractable Drill Bit Technology—Drilling Without Pulling Out Drillpipe, Advanced Drilling Solutions Lessons From the FSU; Jun. 2003; vol. 2, pp. 351-464.
Tommy Warren, SPE, Bruce Houtchens, SPE, Garret Madell, SPE, Directional Drilling With Casing, SPE/IADC 79914, Tesco Corporation, SPE/IADC Drilling Conference 2003.
LaFleur Petroleum Services, Inc., "Autoseal Circulating Head," Engineering Manufacturing, 1992, 11 Pages.
Valves Wellhead Equipment Safety Systems, W-K-M Division, ACF Industries, Catalog 80, 1980, 5 Pages.
Canrig Top Drive Drilling Systems, Harts Petroleum Engineer International, Feb. 1997, 2 Pages.
The Original Portable Top Drive Drilling System, TESCO Drilling Technology, 1997.
Mike Killalea, Portable Top Drives: What's Driving The Marked?, IADC, Drilling Contractor, Sep. 1994, 4 Pages.
500 or 650 ECIS Top Drive, Advanced Permanent Magnet Motor Technology, TESCO Drilling Technology, Apr. 1998, 2 Pages.
500 or 650 HCIS Top Drive, Powerful Hydraulic Compact Top Drive Drilling System, TESCO Drilling Technology, Apr. 1998, 2 Pages.
Product Information (Sections 1-10) CANRIG Drilling Technology, Ltd., Sep. 18, 1996.
Hahn, et al., "Simultaneous Drill and Case Technology—Case Histories, Status and Options for Further Development," Society of Petroleum Engineers, IADC/SPE Drilling Conference, New Orleans, LA Feb. 23-25, 2000 pp. 1-9.
M.B. Stone and J. Smith, "Expandable Tubulars and Casing Drilling are Options" Drilling Contractor, Jan./Feb. 2002, pp. 52.
M. Gelfgat, "Retractable Bits Development and Application" Transactions of the ASME, vol. 120, Jun. (1998), pp. 124-130.
"First Success with Casing-Drilling" Word Oil, Feb. (1999), pp. 25.
Dean E. Gaddy, Editor, "Russia Shares Technical Know-How with U.S." Oil & Gas Journal, Mar. (1999), pp. 51-52 and 54-56.
U.S. Appl. No. 10/794,800, filed Mar. 5, 2004.
U.S. Appl. No. 10/832,804, filed Apr. 27, 2004.
U.S. Appl. No. 10/795,214, filed Mar. 5, 2004.
U.S. Appl. No. 10/794,795, filed Mar. 5, 2004.
U.S. Appl. No. 10/775,048, filed Feb. 9, 2004.
U.S. Appl. No. 10/772,217, filed Feb. 2, 2004.
U.S. Appl. No. 10/788,976, filed Feb. 27, 2004.
U.S. Appl. No. 10/794,797, filed Mar. 5, 2004.
U.S. Appl. No. 10/767,322, filed Jan. 29, 2004.
U.S. Appl. No. 10/795,129, filed Mar. 5, 2004.
U.S. Appl. No. 10/794,790, filed Mar. 5, 2004.
U.S. Appl. No. 10/162,302, filed Jun. 4, 2004.
Rotary Steerable Technology—Technology Gains Momentum, Oil & Gas Journal, Dec. 28, 1998.
Directional Drilling, M. Mims, World Oil, May 1999, pp. 40-43.
Multilateral Classification System w/Example Applications, Alan MacKenzie & Cliff Hogg, World Oil, Jan. 1999, pp. 55-61.
U.S. Appl. No. 10/618,093.
Tarr, et al., "Casing-while-Drilling: The Next Step Change In Well Construction," World Oil, Oct. 1999, pp. 34-40.
De Leon Mojarro, "Breaking A Paradigm: Drilling With Tubing Gas Wells," SPE Paper 40051, SPE Annual Technical Conference And Exhibition, Mar. 3-5, 1998, pp. 465-472.
De Leon Mojarro, "Drilling/Completing With Tubing Cuts Well Costs By 30%," World Oil, Jul. 1998, pp. 145-150.
Littleton, "Refined Slimhole Drillng Technology Renews Operator Interest," Petroleum Engineer International, Jun. 1992, pp. 19-26.
Anon, "Slim Holes Fat Savings," Journal of Petroleum Technology, Sep. 1992, pp. 816-819.
Anon, "Slim Holes, Slimmer Prospect," Journal of Petroleum Technology, Nov. 1995, pp. 949-952.
Vogt, et al., "Drilling Liner Technology For Depleted Reservoir," SPE Paper 36827, SPE Annual Technical Conference And Exhibition, Oct. 22-24, pp. 127-132.
Mojarro, et al., "Drilling/Completing With Tubing Cuts Well Costs By 30%," World Oil, Jul. 1998, pp. 145-150.
Sinor, et al., Rotary Liner Drilling For Depleted Reservoirs, IADC/SPE Paper 39399, IADC/SPE Drilling Conference, Mar. 3-6, 1998, pp. 1-13.
Editor, "Innovation Starts At The Top At Tesco," The American Oil & Gas Reporter, Apr., 1998, p. 65.
Tessari, et al., "Casing Drilling—A Revolutionary Approach To Reducing Well Costs," SPE/IADC Paper 52789, SPE/IADC Drilling Conference, Mar. 9-11, 1999, pp. 221-229.
Silverman, "Novel Drilling Method—Casing Drilling Process Eliminates Tripping String," Petroleum Engineer International, Mar. 1999, p. 15.
Silverman, "Drilling Technology—Retractable Bit Eliminates Drill String Trips," Petroleum Engineer International, Apr. 1999, p. 15.
Laurent, et al., "A New Generation Drilling Rig: Hydraulically Powered And Computer Controlled," CADE/CAODC Paper 99-120, CADE/CAODC Spring Drilling Conference, Apr. 7 & 8, 1999, 14 pages.
Madell, et al., "Casing Drilling An Innovative Approach To Reducing Drilling Costs," CADE/CAODC Paper 99-121, CADE/CAODC Spring Drilling Conference, Apr. 7 & 8, 1999, pp. 1-12.

Tessari, et al., "Focus: Drilling With Casing Promises Major Benefits," Oil & Gas Journal, May 17, 1999, pp. 58-62.
Laurent, et al., "Hydraulic Rig Supports Casing Drilling," World Oil, Sep. 1999, pp. 61-68.
Perdue, et al., "Casing Technology Improves," Hart's E & P, Nov. 1999, pp. 135-136.
Warren, et al., "Casing Drilling Application Design Considerations," IADC/SPE Paper 59179, IADC/SPE Drilling Conference, Feb. 23-25, 2000 pp. 1-11.
Warren, et al., "Drilling Technology: Part I—Casing Drilling With Directional Steering In The U.S. Gulf Of Mexico," Offshore, Jan. 2001, pp. 50-52.
Warren, et al., "Drilling Technology: Part II—Casing Drilling With Directional Steering In The Gulf Of Mexico," Offshore, Feb. 2001, pp. 40-42.
Shepard, et al., "Casing Drilling: An Emerging Technology," IADC/SPE Paper 67731, SPE/IADC Drilling Conference, Feb. 27-Mar. 1, 2001, pp. 1-13.
Editor, "Tesco Finishes Field Trial Program," Drilling Contractor, Mar./Apr. 2001, p. 53.
Warren, et al., "Casing Drilling Technology Moves To More Challenging Application," AADE Paper 01-NC-HO-32, AADE National Drilling Conference, Mar. 27-29, 2001, pp. 1-10.
Shephard, et al., "Casing Drilling: An Emerging Technology," SPE Drilling & Completion, Mar. 2002, pp. 4-14.
Shephard, et al., "Casing Drilling Successfully Applied In Southern Wyoming," World Oil, Jun. 2002, pp. 33-41.
Forest, et al., "Subsea Equipment For Deep Water Drilling Using Dual Gradient Mud System," SPE/IADC Drilling Conference, Amsterdam, The Netherlands, Feb. 27, 2001-Mar. 1, 2001, 8 pages.
World's First Drilling With Casing Operation From A Floating Drilling Unit, Sep. 2003, 1 page.
Filippov, et al., "Expandable Tubular Solutions," SPE paper 56500, SPE Annual Technical Conference And Exhibition, Oct. 3-6, 1999, pp. 1-16.
Coronado, et al., "Development Of A One-Trip ECP Cement Inflation And Stage Cementing System For Open Hole Completions," IADC/SPE Paper 39345, IADC/SPE Drilling Conference, Mar. 3-6, 1998, pp. 473-481.
Coronado, et al., "A One-Trip External-Casing-Packer Cement-Inflation And Stage-Cementing System," Journal Of Petroleum Technology, Aug. 1998, pp. 76-77.
Quigley, "Coiled Tubing And Its Applications," SPE Short Course, Houston, Texas, Oct. 3, 1999, 9 pages.
Bayfiled, et al., "Burst And Collapse Of A Sealed Multilateral Junction: Numerical Simulations," SPE/IADC Paper 52873, SPE/IADC Drilling Conference, Mar. 9-11, 1999, 8 pages.
Marker, et al. "Anaconda: Joint Development Project Leads To Digitally Controlled Composite Coiled Tubing Drilling System," SPE paper 60750, SPE/ICOTA Coiled Tubing Roundtable, Apr. 5-6, 2000, pp. 1-9.
Cales, et al., Subsidence Remediation—Extending Well Life Through The Use Of Solid Expandable Casing Systems, AADE Paper 01-NC-HO-24, American Association Of Drilling Engineers, Mar. 2001 Conference, pp. 1-16.
Coats, et al., "The Hybrid Drilling Unite: An Overview Of an Integrated Composite Coiled Tubing And Hydraulic Workover Drilling System," SPE Paper 74349, SPE International Petroleum Conference And Exhibition, Feb. 10-12, 2002, pp. 1-7.
Sander, et al., "Project Management And Technology Provide Enhanced Performance For Shallow Horizontal Wells," IADC/SPE Paper 74466, IADC/SPE Drilling Conference, Feb. 26-28, 2002, pp. 1-9.
Coats, et al., "The Hybrid Drilling System: Incorporating Composite Coiled Tubing And Hydraulic Workover Technologies Into One Integrated Drilling System," IADC/SPE Paper 74538, IADC/SPE Drilling Conference, Feb. 26-28, 2002, pp. 1-7.
Galloway, "Rotary Drilling With Casing—A Field Proven Method Of Reducing Wellbore Construction Cost," Paper WOCD-0306092, World Oil Casing Drilling Technical Conference, Mar. 6-7, 2003, pp. 1-7.
Fontenot, et al., "New Rig Design Enhances Casing Drilling Operations In Lobo Trend," paper WOCD-0306-04, World Oil Casing Drilling Technical Conference, Mar. 6-7, 2003, pp. 1-13.
McKay, et al., "New Developments In The Technology Of Drilling With Casing: Utilizing A Displaceable DrillShoe Tool," Paper WOCD-0306-05, World Oil Casing Drilling Technical Conference, Mar. 6-7, 2003, pp. 1-11.
Sutriono—Santos, et al., "Drilling With Casing Advances To Floating Drilling Unit With Surface BOP Employed," Paper WOCD-0307-01, World Oil Casing Drilling Technical Conference, Mar. 6-7, 2003, pp. 1-7.
Vincent, et al., "Liner And Casing Drilling—Case Histories And Technology," Paper WOCD-0307-02, World Oil Casing Drilling Technical Conference, Mar. 6-7, 2003, pp. 1-20.
Maute, "Electrical Logging: State-of-the Art," The Log Analyst, May-Jun. 1992, pp. 206-227.
Tessari, et al., "Retrievable Tools Provide Flexibility for Casing Drilling," Paper No. WOCD-0306-01, World Oil Casing Drilling Technical Conference, 2003, pp. 1-11.
Evans, et al., "Development And Testing Of An Economical Casing Connection For Use In Drilling Operations," paper WOCD-0306-03, World Oil Casing Drilling Technical Conference, Mar. 6-7, 2003, pp. 1-10.
Alexander Sas-Jaworsky and J.G. Williams, Development of Composite Coiled Tubing For Oilfield Services, SPE 26536, Society of Petroleum Engineers, Inc., 1993.
A. S. Jafar, H.H. Al-Attar, and I. S. El-Ageli, Discussion and Comparison of Performance of Horizontal Wells in Bouri Field, SPE 36927, Society of Petroleum Engineers, Inc. 1996.
G. F. Boykin, The Role of a Worldwide Drilling Organization and the Road to the Future, SPE/IADC 37630, 1997.
M. S. Fuller, M. Littler, and I. Pollock, Innovative Way to Cement a Liner Utilizing a New Inner String Liner Cementing Process, 1998.
Helio Santos, Consequences and Relevance of Drillstring Vibration on Wellbore Stability, SPE/IADC 52820, 1999.
Chan L. Daigle, Donald B. Campo, Carey J. Naquin, Rudy Cardenas, Lev M. Ring, Patrick L. York, Expandable Tubulars: Field Examples of Application in Well Construction and Remediation, SPE 62958, Society of Petroleum Engineers Inc., 2000.
C. Lee Lohoefer, Ben Mathis, David Brisco, Kevin Waddell, Lev Ring, and Patrick York, Expandable Liner Hanger Provides Cost-Effective Alternative Solution, IADC/SPE 59151, 2000.
Kenneth K. Dupal, Donald B. Campo, John E. Lofton, Don Weisinger, R. Lance Cook, Michael D. Bullock, Thomas P. Grant, and Patrick L. York, Solid Expandable Tubular Technology—A Year of Case Histories in the Drilling Environment, SPE/IADC 67770, 2001.
Mike Bullock, Tom Grant, Rick Sizemore, Chan Daigle, and Pat York, Using Expandable Solid Tubulars To Solve Well Construction Challenges in Deep Waters And Maturing Properties, IBP 27500, Brazilian Petroleum Institute—IBP, 2000.
Coiled Tubing Handbook, World Oil, Gulf Publishing Company, 1993.

* cited by examiner

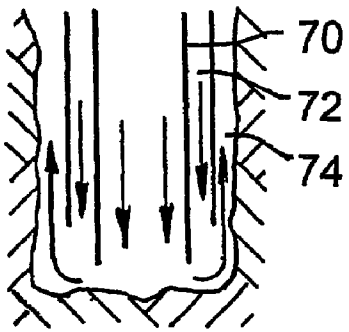
Fig.8a
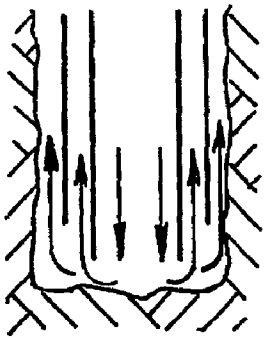
Fig.8b
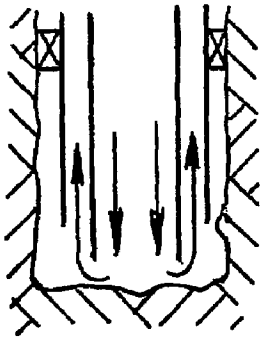
Fig.8c
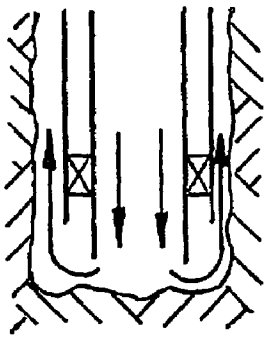
Fig.8d
Fig.8e
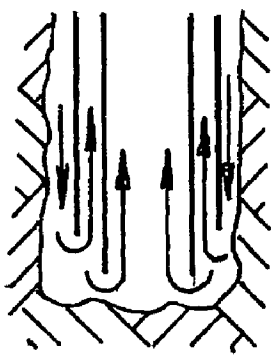
Fig.8f
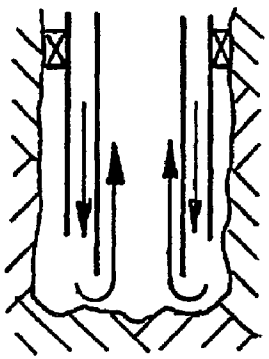
Fig.8g
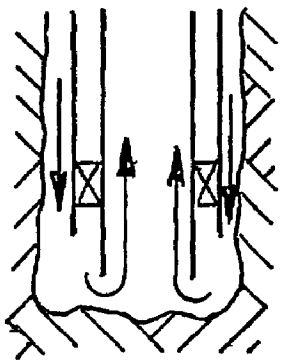
Fig.8h

DRILLING METHOD

This invention relates to a drilling method, and also to drilling apparatus.

When drilling a bore to, for example, access a subsurface hydrocarbon-bearing formation, it is conventional to: drill a bore using a bit mounted on the end of an elongate support; retrieve the bit and its support; run casing into the bore; and then cement the casing in the bore. Clearly such an operation is time consuming and expensive, and restricts the range of hydrocarbon reservoirs which it is commercially viable to access.

It is among the objectives of embodiments of the present invention to provide a drilling method which is relatively straightforward to execute and which will allow commercial exploitation of, for example, smaller or less accessible hydrocarbon reservoirs.

According to the present invention there is provided a method of drilling and lining a bore in an earth formation, the method comprising the steps:

providing a tubular outer elongate member and an inner elongate member located within the outer member;

mounting a drill bit to one of the members; and drilling a bore by advancing the drill bit through the earth formation and advancing the members through the bore.

The present invention also relates to the apparatus used in implementing the method.

Thus, it is possible to create a lined drilled bore without the need to run in and retrieve a drill support and then run in a bore liner; the bore is immediately lined by the tubular outer element. Also, the constant presence of the outer member assists in avoiding and addressing difficulties which occur when the bore intersects a problem formation.

Preferably, at least one of the inner and outer members is a support member capable of transmitting force.

Preferably, at least one, and most preferably both, of the members are spoolable.

The use of spoolable supports simplifies the surface apparatus necessary to support the drilling operation, and allows the drilling operation, and retrieving the inner support, if desired, to be carried out relatively quickly and inexpensively: in many cases, it may be possible to carry out the drilling and lining operation without requiring provision of a drilling derrick and associated apparatus; the supports may be run in and retrieved using an injector head and lubricator, or any other suitable method of pressure containment, so that they may be conveyed with the well in production. In other embodiments of the invention, the members may be sectional or jointed, for example one of the members may be formed of jointed pipe, may be expandable, or may be formed of a composite material such as a fibre glass or carbon fibre material.

Preferably, the inner elongate member is tubular. Thus, the inner support may, for example, be used as a conduit for carrying drilling fluid from surface. Further, the inner support may remain in the bore to serve as a conduit for carrying production fluids to surface. This is often termed a "dual concentric completion" or a "velocity string". Alternatively, the inner support is retrieved while the outer support remains in the bore.

Preferably, the inner and outer supports are coaxial. Where necessary, appropriate spacers may be provided between the supports.

Preferably, a fluid, typically a drilling fluid or "mud", is pumped into the bore during the drilling step. The fluid may be passed through a selected one or more of the channels defined by a tubular inner support, an inner annulus between the inner support and the outer support, or an outer annulus between the outer support and the bore wall, and returned to surface via one or more of the other channels. The fluid may be utilised to drive a downhole motor, which may be a positive displacement motor and may be utilised to drive the drill bit, and may serve as a medium for transmission of pressure pulse signals from a measurement-while-drilling (MWD) apparatus, which will typically be provided as part of a bottom hole assembly (BHA), to surface. Gas or another low density fluid may also be pumped into the bore during the drilling step, either mixed into the fluid or separately through one of the channels for mixing with the drilling fluid at or adjacent the drill bit and reducing the hydrostatic head resulting from the column of fluid above the bit, and facilitating "underbalance" drilling. The presence of gas in one or more of the channels may also be used to increase the effective buoyancy of the supports, and even provide a degree of positive buoyancy, and facilitate the drilling of longer reach bores. The channels may be selectively closed or sealed as desired, selected individually at will, and the direction of fluid circulation may be varied or reversed, as drilling conditions require.

Preferably, the drill bit is mounted to the inner support, or a BHA on the inner support. The inner support may itself be coupled to the outer support, facilitating the transmission of forces from surface, for example the application of weight on bit (WOB), and providing resistance to torsion, tension and other forces, by the larger diameter outer support. At least a portion of the inner support may thus be relatively light and flexible, and need not be capable of withstanding any significant torsion, tension or compression. Preferably, the coupling between the inner and outer supports is remotely disengageable, to facilitate retrieval of the inner support. The coupling may be disengaged by any appropriate means, including electrically, mechanically or hydraulically actuated means, or means actuated by a combination of inputs.

Preferably, the drill bit is collapsable, such that the bit may be retrieved through the outer support. Alternatively, the bit may be expendable or sacrificial, that is the drill bit and also possibly other BHA components and sections of the inner member, may be disengageable and remain at the end of the bore.

Preferably, the drill bit is expandable, such that, for example, the bit may be run into a cased bore and then expanded below the casing to a larger diameter than the inner diameter of the casing, and of course to a larger diameter than the outer member.

Preferably, a bottom hole assembly (BHA) is located at least partially within the outer member, and is preferably mounted to the inner member. Thus, the BHA is protected by the presence of the outer member during the drilling operation. The BHA is preferably coupled to the outer member, which coupling may be via the inner member, such that stresses experienced or created by the BHA are transferred to the outer member.

A downhole tractor may be provided to apply weight to the bit or to pull the members through the bore. The tractor may be powered by any appropriate means. The tractor may be expandable or retractable.

The members may be of any appropriate material, including metals such as steel or other alloys, composites, or any combination thereof.

One or both of the members may comprise signal conductors, for example embedded conductors for power or signal transmission, or fibre optic cables. One or both members may contain one or more signal conductors.

The outer member may comprise a pressure containment layer. The outer member may comprise an inner low friction liner or coating, to facilitate withdrawal of the inner member.

The outer member may be expandable, and the method may include the further step of expanding the outer member to a larger diameter.

The outer member may extend the length of the inner member, or may extend over only a distal or intermediate portion of the inner member; if a section of bore is being drilled beyond a length of cased bore, the outer member may be of a length corresponding to the length of the bore section to be drilled.

One or both of the outer member and the inner member may form part of a velocity string.

If desired, additional tubular members or supports may be provided, and alternatively or in addition, additional tubular members providing little or no support may be provided.

A packer or other sealing arrangement may be provided between the inner and outer members. Alternatively, or in addition, a packer or other sealing arrangement may be provided between the outer member and bore wall. In a further alternative, a packer or other sealing arrangement may be provided inside the inner member to seal an inner diameter of the inner member. The packer or other sealing arrangement may be pumped down inside the inner member. This may be used to provide pressure containment of the inner member. This may be particularly advantageous where the bit and\or other BHA components are disengaged from the inner member, as this may allow sealing prior to disengagement.

These and other aspects of the present invention will now be described, by way of example, with reference to the accompanying drawings, in which.

Figure 9:
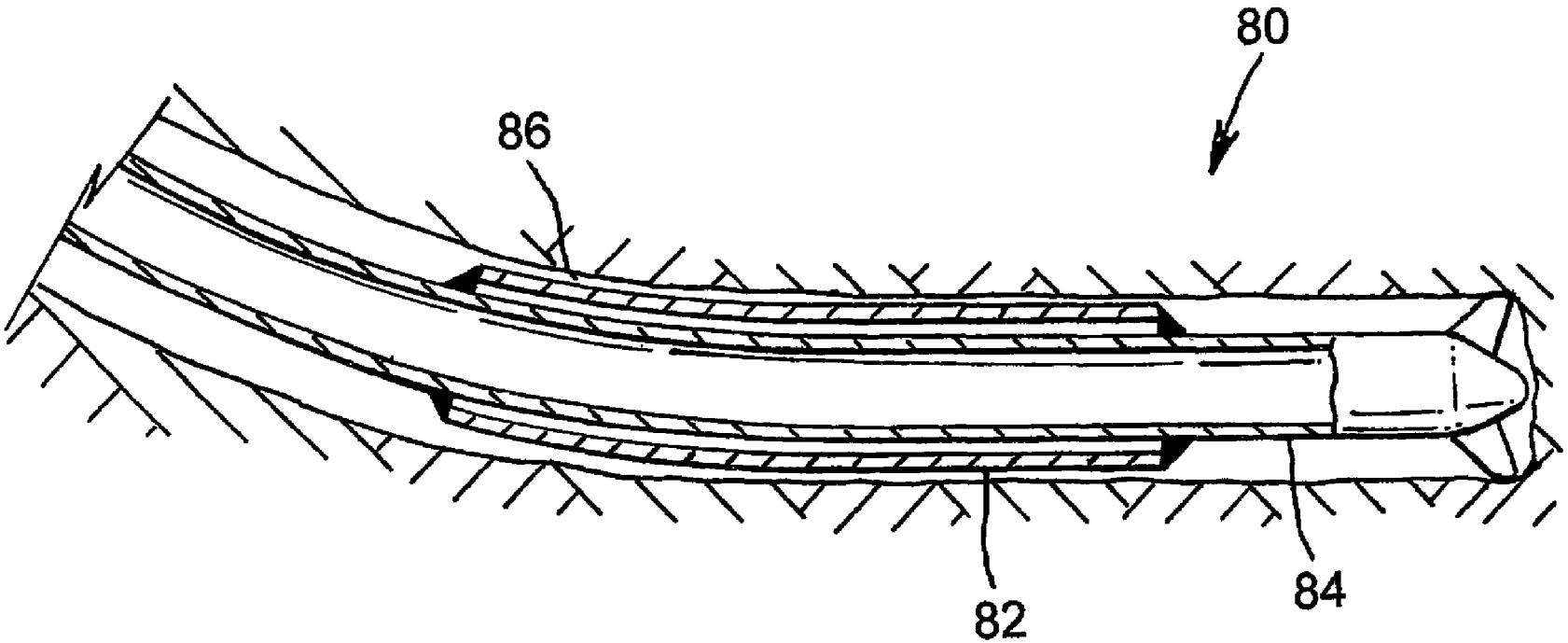
Figure 10:
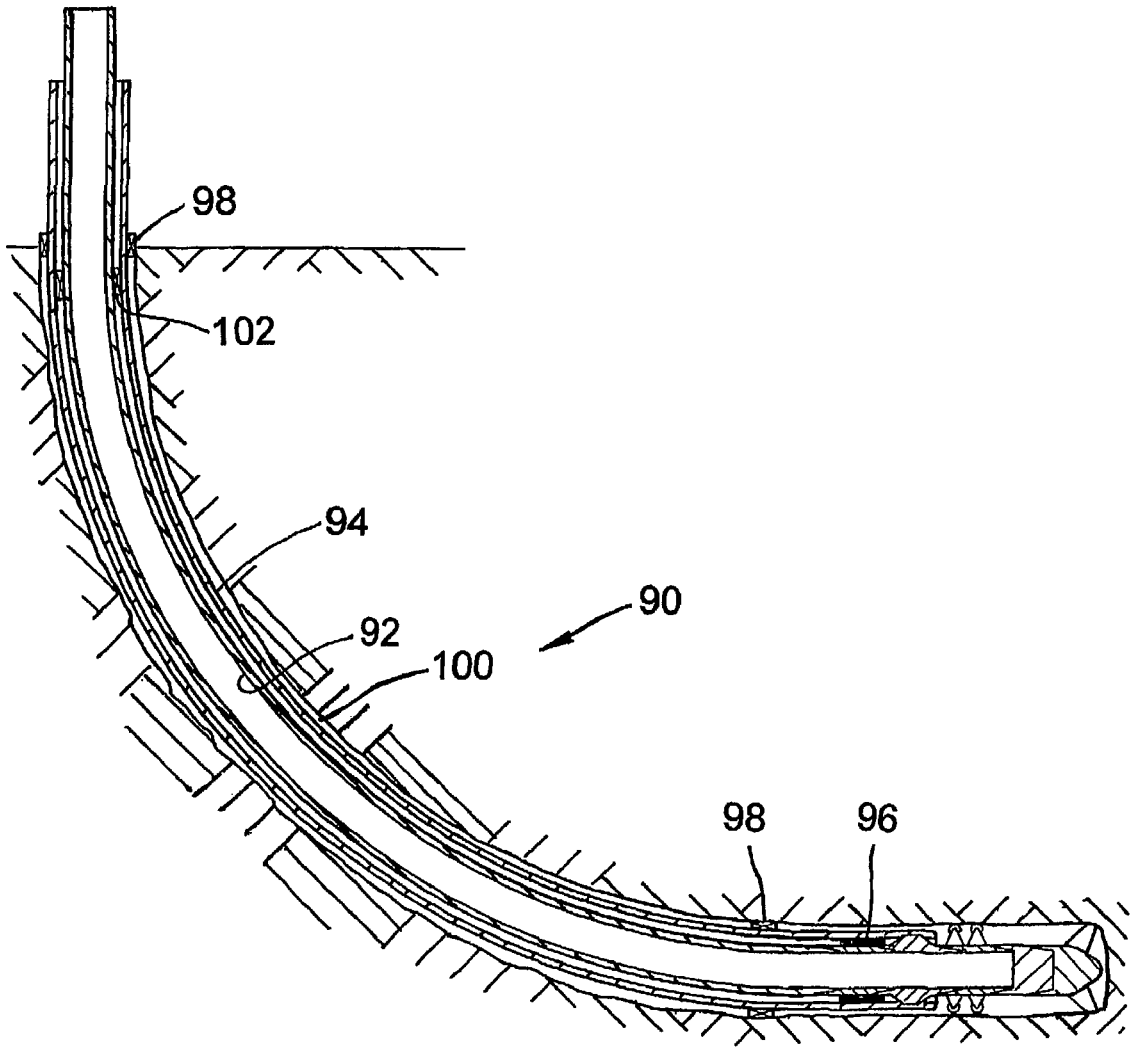

FIGS. 8*a*–8*h* of the drawings are schematic illustrations of part of an apparatus in accordance with an embodiment of the present invention, and illustrating various possible circulation configurations; and FIGS. 9 and 10 are schematic part-sectional views of apparatus in accordance with additional embodiments of the present invention.

Figure 11:
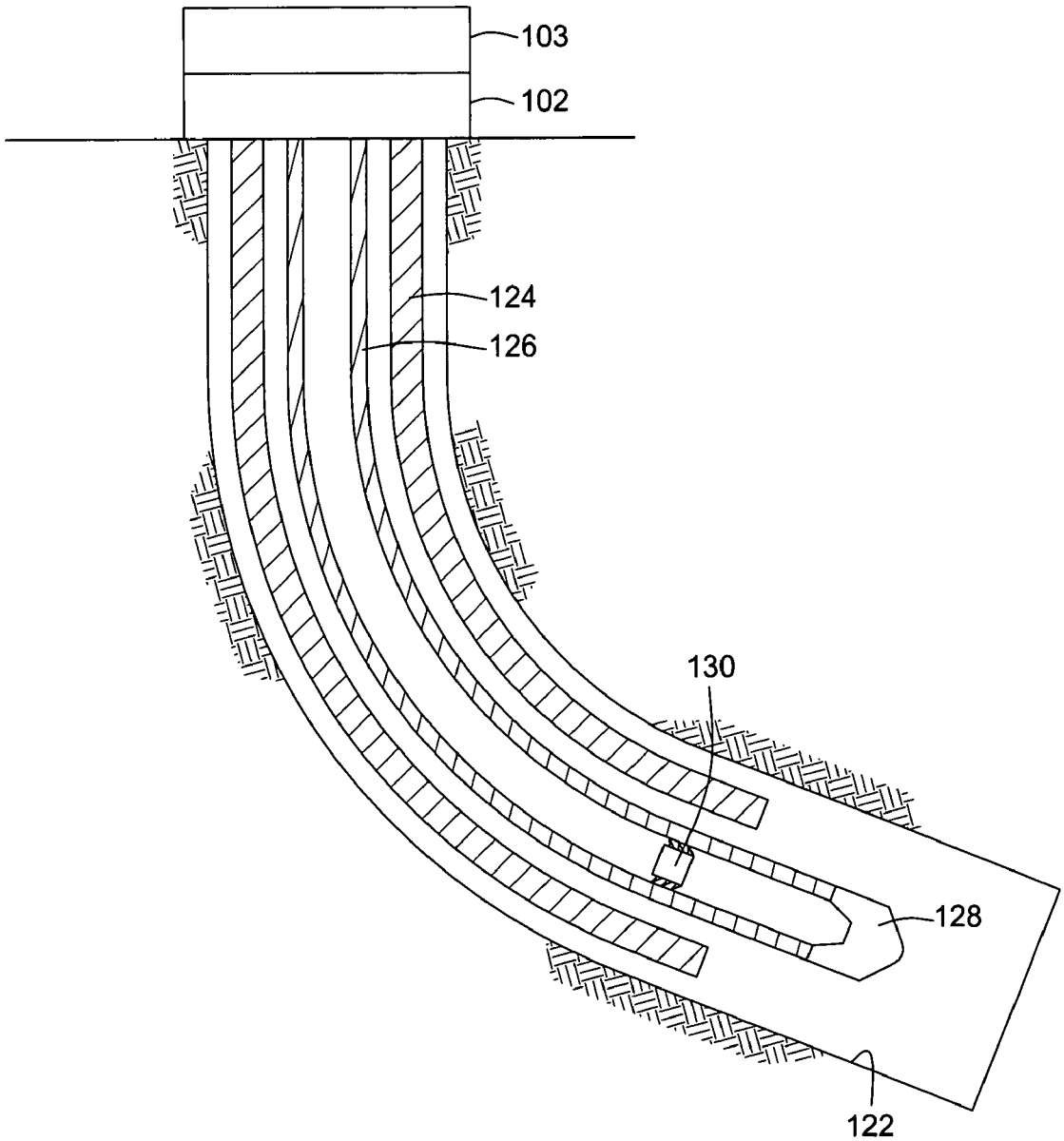

FIG. 11 shows another embodiment of the apparatus with the sealing arrangement.

Figure 12:
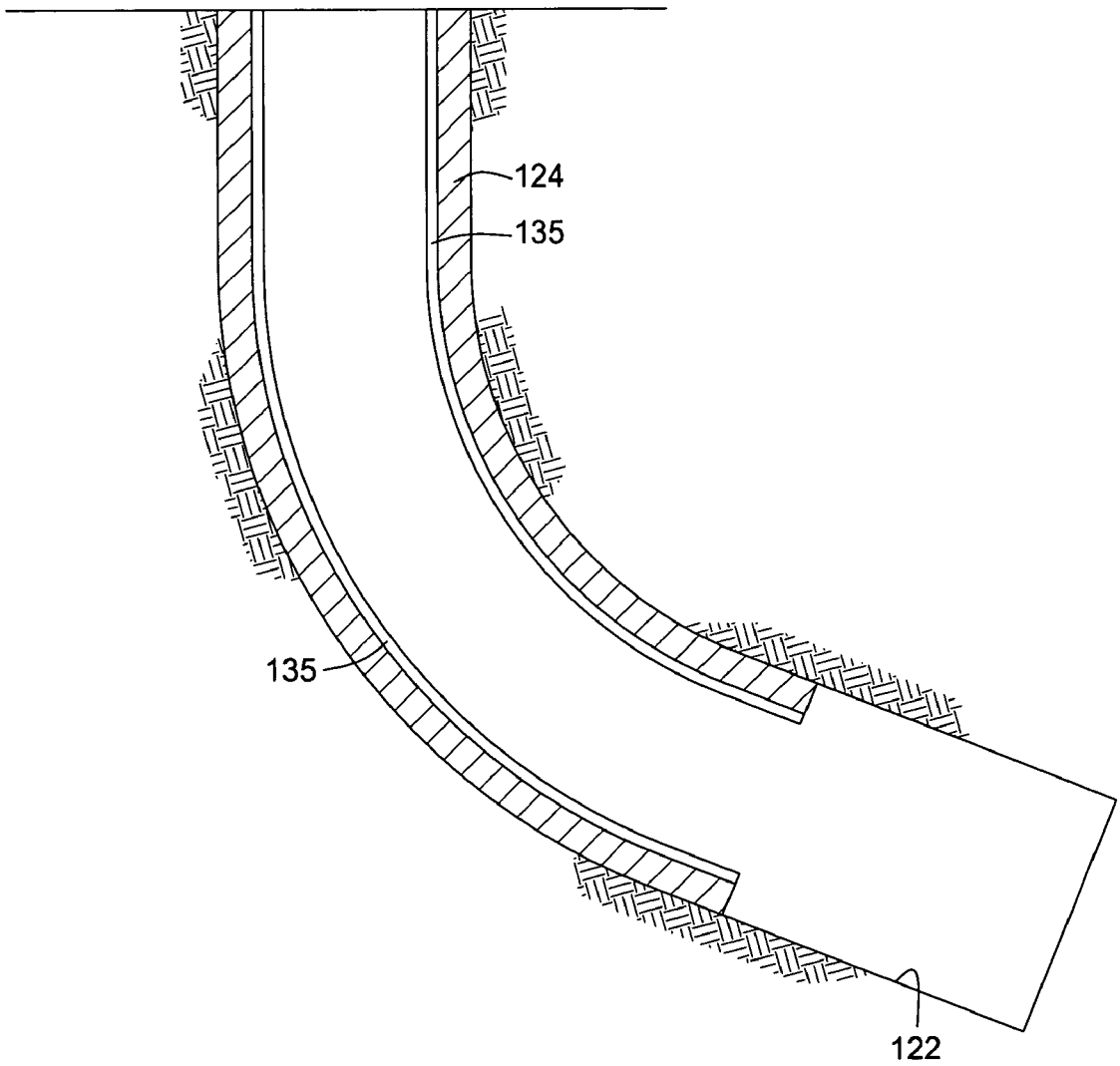

FIG. 12 shows an embodiment of the apparatus after the outer tubing has been expanded.

Figure 1:
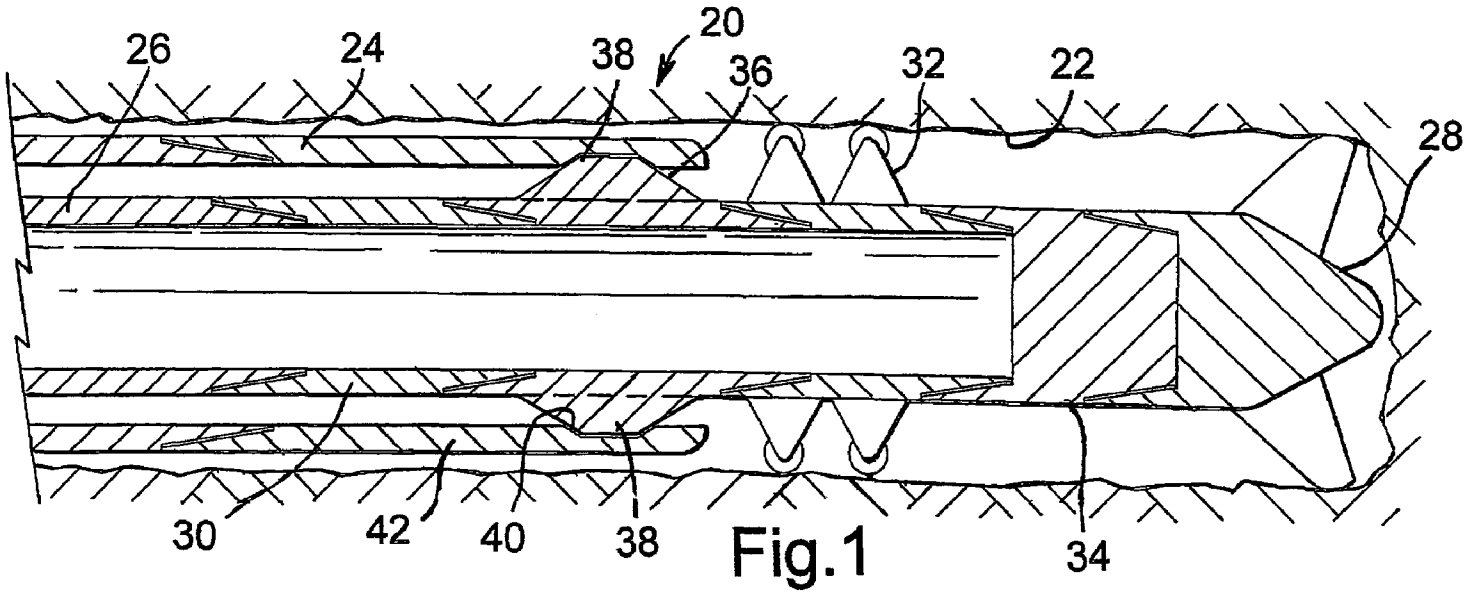
FIG. 1 is a schematic, part-sectional view of apparatus in accordance with a preferred embodiment of the present invention.

Reference is first made to FIG. 1 of the drawings, which illustrates apparatus 20 in accordance with a preferred embodiment of the present invention, and in particular the distal end of the apparatus being illustrated in the course of a drilling operation.

The apparatus 20 is shown located in the end of the drilled bore 22 and comprises outer tubing 24 and inner tubing 26, with an expandable drill bit 28 being mounted on the inner tubing 26.

In this embodiment, both the inner and outer tubing 26, 24 extend to surface. The inner tubing 26 provides mounting for various drilling apparatus, including a measurement-while-drilling (MWD) device 30 which transmits information to surface via pressure pulses in the drilling fluid passing through the inner tubing 26. An expandable tractor 32 is mounted on the inner tubing 26 and extends beyond the end of the outer tubing 24, the tractor 32, being drilling fluid driven to advance the apparatus 20 through the bore 22. A positive displacement motor (PDM) 34 is mounted below the tractor 32, and is drilling fluid—fluid driven to rotate the bit 28.

During drilling, the ends of the inner and outer tubing 26, 24 are coupled together by a latch sub 36, mounted on the inner tubing 26 between the MWD 30 and the tractor 32, which has radially extendable keys or dogs 38 for engaging a profile 40 provided on an outer tubing end joint 42. This allows linear forces, such as tension forces, and torque to be transmitted between the larger diameter and generally more compression and torsion resistant outer tubing 24 and the inner tubing 26.

Figure 2:
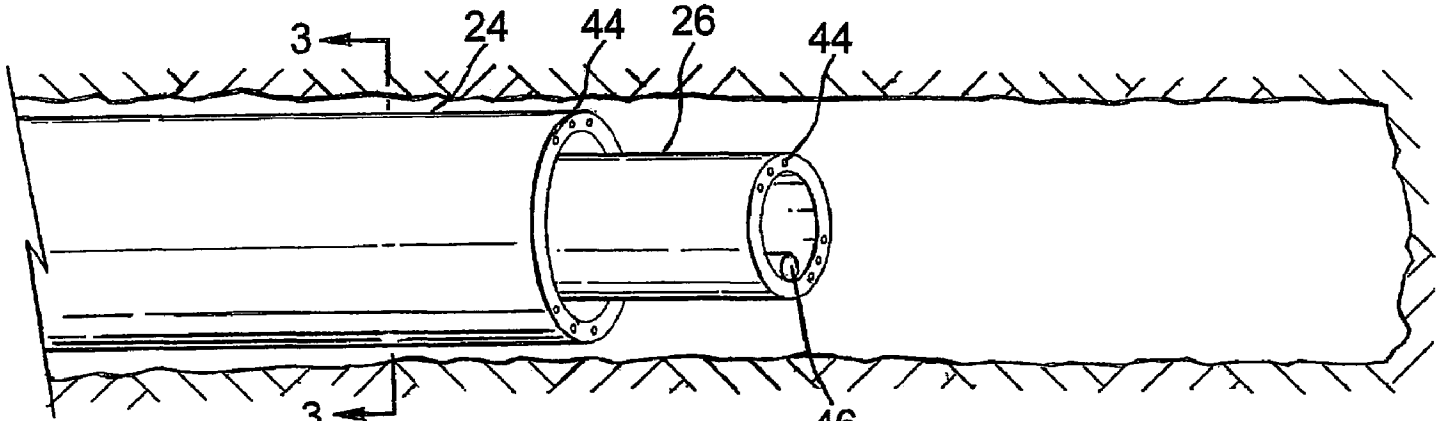
FIG. 2 is a schematic part cut away perspective view of a portion of the apparatus of FIG. 1.
Figure 3:
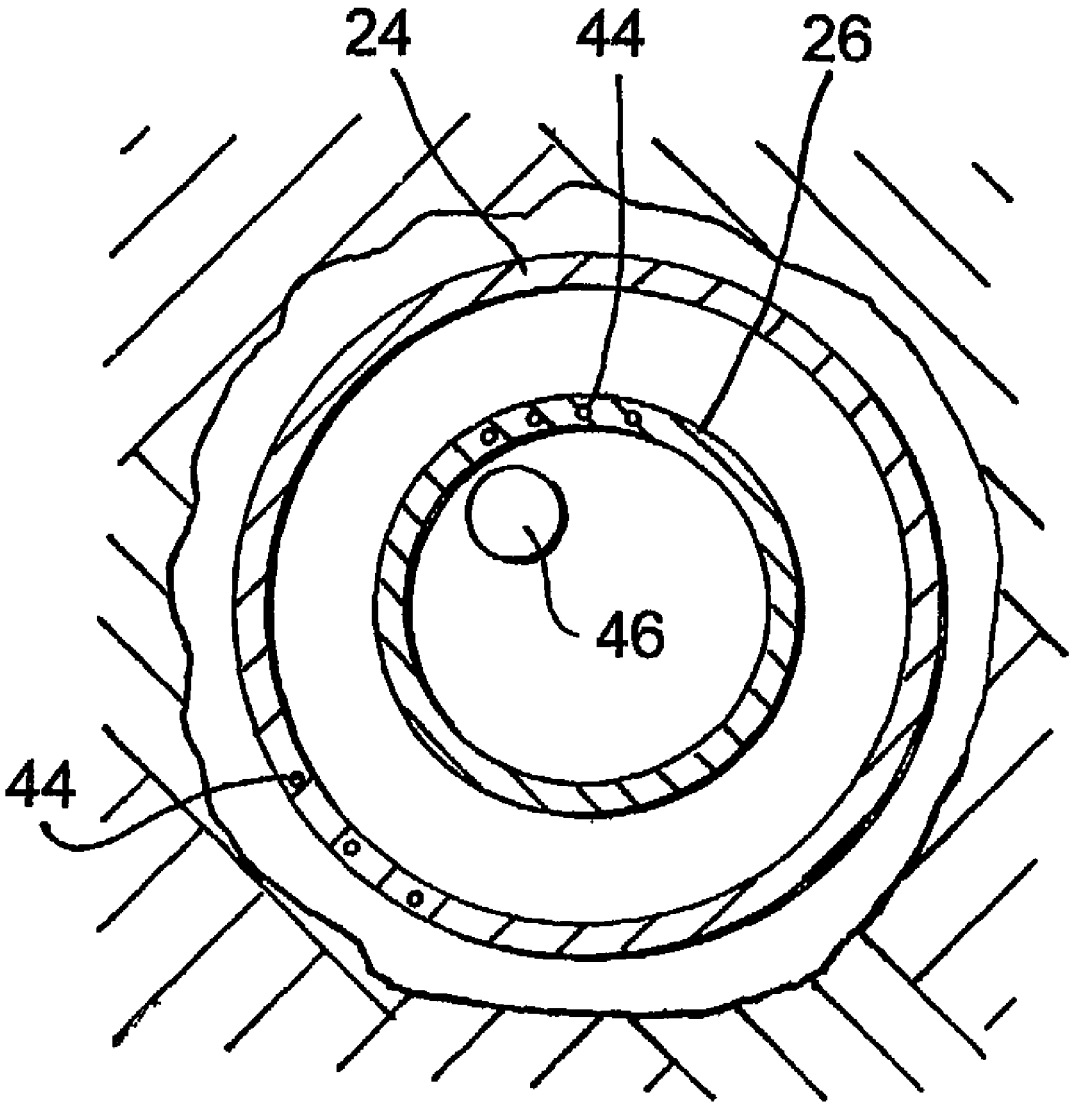
FIG. 3 is a sectional view on line 3—3 of FIG. 2.

Reference is now also made to FIGS. 2 and 3 of the drawings, which illustrate further details of the inner and outer tubing 26, 24. In particular, it may be seen that the walls of both the inner and outer tubing include embedded signal transmission members 44 in the form of fibre optic and electric cables for power transmission from surface to elements of the bottom hole assembly (BHA) and for data transmission from the BHA to surface. As illustrated, the inner tubing 26 may also accommodate a larger diameter cable or umbilical 46.

Figure 4:
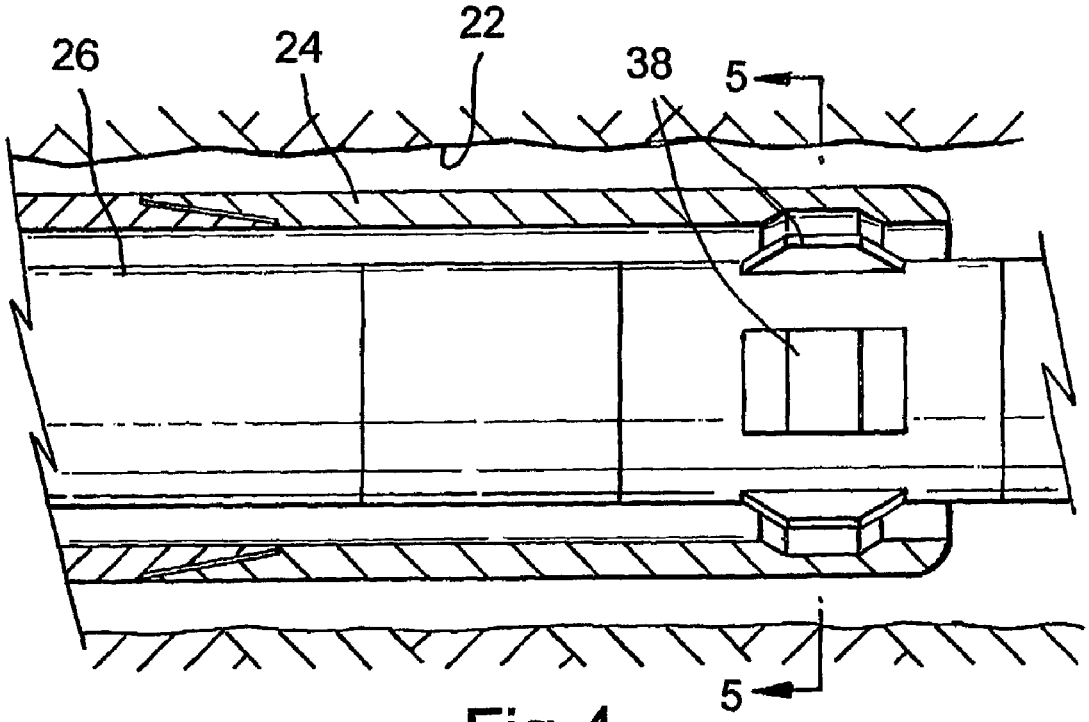
FIG. 4 is a side view of a portion of the apparatus of FIG. 1; showing elements of the apparatus in the process of disengaging.
Figure 5:
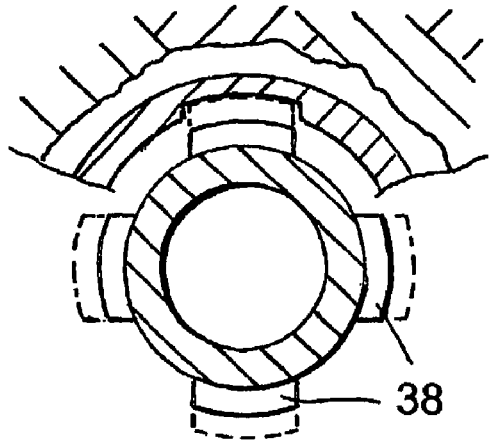
FIG. 5 is a sectional view on line 5—5 of FIG. 4.
Figure 6:
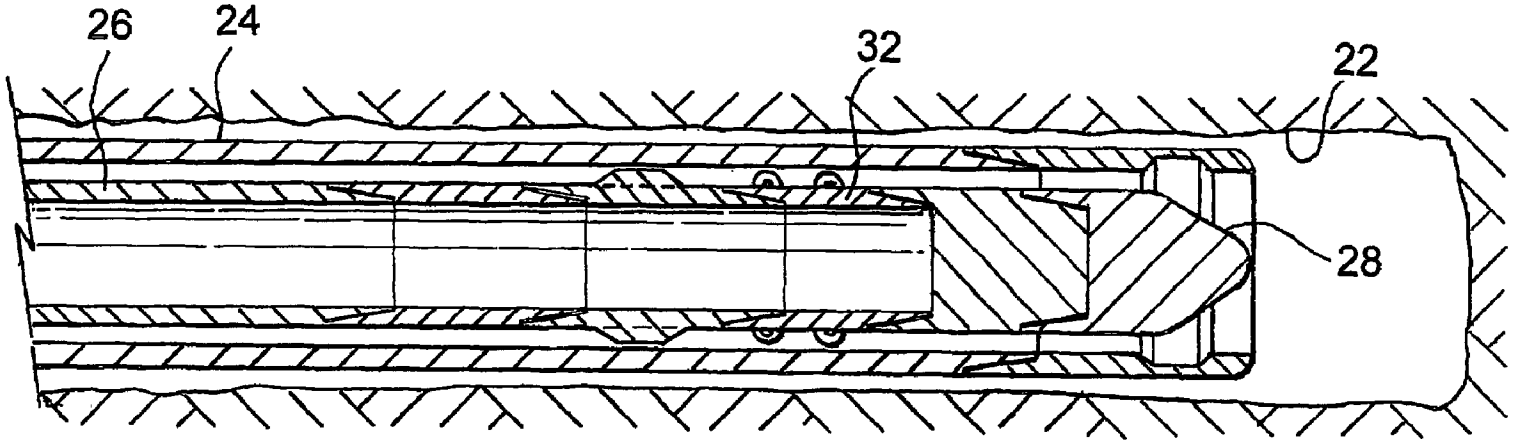
FIG. 6 is a part-sectional view of the apparatus of FIG. 1, shown in the process of retraction of an inner support of the apparatus.

Reference is now made to FIGS. 4, 5 and 6 of the drawings, which illustrate steps in the retrieval of the inner tubing 26.

When a drilling operation has been completed, or it is desired to retrieve the inner tubing 26 and BHA for some other reasons, the latch dogs 38 are retracted, as are the tractor 32 and bit 28. The BHA may then be retrieved through the outer tubing 24 and pulled to surface, while the outer tubing 24 remains in the bore 22. Alternatively, the BHA may be ejected from the end of the inner tubing 24.

Figure 7:
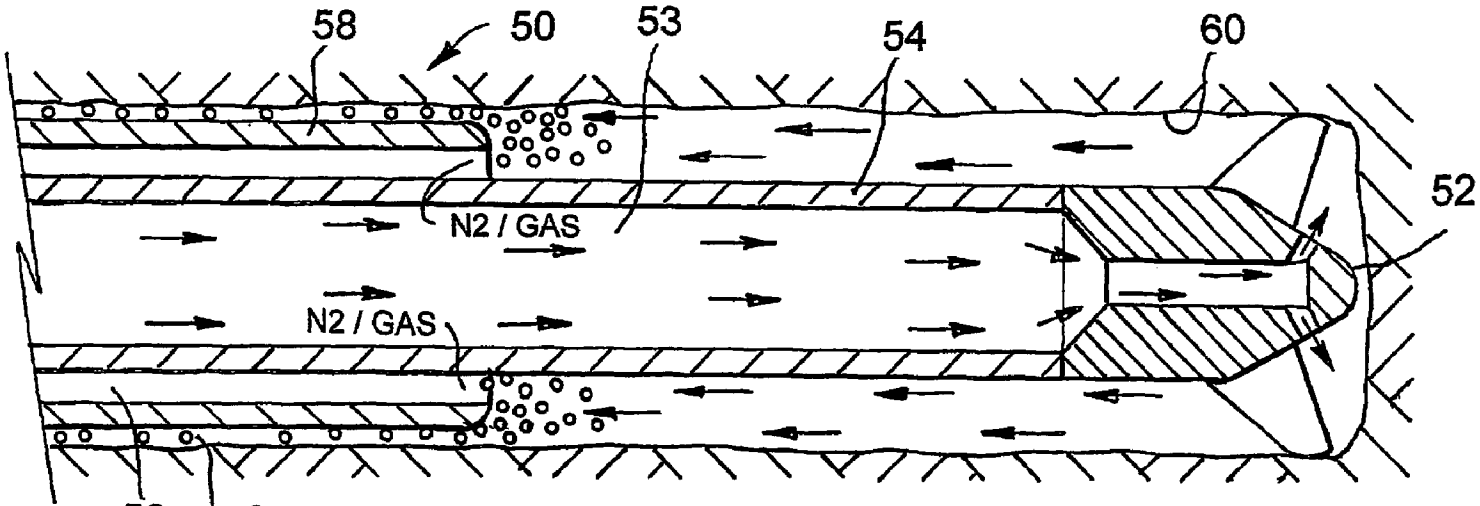
FIG. 7 is a schematic sectional view of apparatus in accordance with another embodiment of the invention; being utilised in an underbalance drilling operation.

Reference is now made to FIG. 7 of the drawings, which illustrates apparatus 50 of another embodiment of the invention being utilised in an underbalance drilling operation. In practice, the apparatus 50 will include many of the features of the apparatus 20 described above, however these have been omitted from the figure in the interest of clarity.

Drilling fluid is being supplied to the drill bit 52 via the bore 53 of the inner tubing 54, which fluid powers the MWD and PDM (not shown) and facilitates data transfer from the PDM to surface. The inner annulus 56 between the inner tubing 54 and the outer tubing 58 is utilised to transport nitrogen gas from surface.

The drilling fluid, drill cuttings and gas mix in the bottom end of the drill, bore 60, and travel to the surface via the outer annulus 62 between the outer tubing 58 and the wall of the drilled bore 60.

The presence of the gas in the inner annulus 56 increases the buoyancy of the tubing string, which may be useful, particularly in extended reach wells.

The tubing arrangement of the embodiments of the invention provides a high degree of flexibility in circulation, as illustrated in FIGS. 8*a*–8*h* of the drawings. The figures illustrate that one or more of the inner tubing 70, inner annulus 72, and outer annulus 74 may be utilised to deliver fluid from surface, or return or deliver fluid to surface. As illustrated in FIGS. 8*c*, 8*d*, 8*g* and 8*h*, one of the inner or outer annuli may be sealed to prevent fluid passage therethrough.

FIG. 9 shows apparatus 80 in accordance with a still further embodiment of the invention. In this example, the outer tubing 82 extends only over a relatively short section of the inner tubing 84. This arrangement may be useful to, for example, accelerate return fluid in the outer annulus 86 as it passes around the tubing 82, or the tubing 82 may serve as a 'patch'. Alternatively, the arrangement can be used to transport a length of outer tubing such as the outer tubing 82, corresponding to the length of an open hole to be drilled. This may be of particular use in, for example, drilling of a lateral borehole; it will be understood that packers (not shown) may be provided for selective sealing of the outer annulus 86, either between the outer or inner tubing 82, 84 and the bore.

FIG. 10 illustrates a further alternative embodiment, in which the tubing of the apparatus 90 serves as a double pressure barrier, the inner tubing 92 serving as a first barrier and the outer tubing 94 serving as a second barrier. A seal 96 between the inner and outer tubing 92, 94 may be arranged to permit circulation in one direction or to prevent flow on altogether, thus forming a dual pressure barrier at surface and along the length of the bore. Also packers 98 may be provided for sealing external annulus at one or both of the lower end of the apparatus 90 and at surface, and an additional packer 102 may be provided to act as a dual inner annulus barrier.

In another embodiment, FIG. 11 shows the inner tubing 126 disposed inside the outer tubing 124. An injector head 103 and lubricator 102 are provided to inject or retrieved one or both of the tubings 124, 126. As shown, a sealing arrangement 130 is being pumped down the inner tubing 126 towards the drill bit 128.

FIG. 12 shows the outer tubing 124 expanded and the inner tubing 126 retrieved to the surface. It can be seen that the outer tubing 124 was provided with a coating 135 to facilitate the retrieval of the inner tubing 126.

It will be apparent to those of skill in the art that the above described embodiments are merely examples of the invention and that various modifications and improvements may be made thereto, without departing from the scope of the invention.

The invention claimed is:

1. A method of drilling a bore in an earth formation, the method comprising:

providing an outer elongate member attached to an inner elongate member, the inner elongated member at least partially disposed within the outer member;

mounting a drill bit to one of the members;

flowing fluid through an inner annulus between the inner member and the outer member; and advancing the inner member, the outer member, and the drill bit through the earth formation, thereby forming the bore.

2. The method of claim 1, further comprising providing both members in the form of spoolable members.

3. The method of claim 1, further comprising transmitting force to or from the bit via at least one of the inner and outer members.

4. The method of claim 1, further comprising retrieving at least one of the members using an injector head and lubricator.

5. The method of claim 4, further comprising conveying at least one of the members into the bore while the bore is in production.

6. The method of claim 1, wherein one of the members comprises pipe sections.

7. The method of claim 1, further comprising expanding the outer member.

8. The method of claim 1, further comprising retrieving the inner member while the outer member remains in the bore.

9. The method of claim 1, wherein the fluid comprises drilling fluid.

10. The method of claim 9, wherein the fluid is passed through a channel defined by the inner member.

11. The method of claim 10, wherein the fluid is returned to surface via the inner annulus.

12. The method of claim 9, wherein the fluid is passed through a channel defined by an outer annulus between the outer member and the bore wall.

13. The method of claim 9, wherein the fluid is utilized to drive at least one of a downhole motor, tractor or other BHA component.

14. The method of claim 9, wherein the fluid serves as a medium for transmission of pressure pulse signals from a measurement-while-drilling (MWD) apparatus to surface.

15. The method of claim 9, wherein gas is pumped into the bore during the drilling.

16. The method of claim 15, wherein the gas is mixed with the fluid at surface.

17. The method of claim 15, wherein the gas is pumped into the bore separately of the fluid and mixed with the drilling fluid at or adjacent the drill bit.

18. The method of claim 15, wherein the presence of gas is utilized to increase the effective buoyancy of the members.

19. The method of claim 1, further comprising utilizing at least one of the members to carry production fluids to surface.

20. The method of claim 1, further comprising closing a channel at least partially defined by one or more of the members.

21. The method of claim 1, further comprising circulating fluid in a first direction through channels at least partially defined by one or more of the members and then changing the direction of fluid circulation.

22. The method of claim 1, further comprising coupling the inner member to the outer member.

23. The method of claim 22, further comprising disengaging the coupling and retrieving the inner member.

24. The method of claim 1, further comprising collapsing the drill bit and retrieving the bit through the outer member.

25. The method of claim 1, further comprising: mounting the bit on the inner member; disengaging the bit from said member; and retrieving at least a portion of the inner member.

26. The method of claim 1, further comprising expanding the drill bit.

27. The method of claim 26, further comprising running the bit into a cased bore and then expanding the bit below the casing to a larger diameter than the inner diameter of the casing.

28. The method of claim 1, further comprising locating a bottom hole assembly (BHA) at least partially within the outer member.

29. The method of claim 28, further comprising mounting the BHA to the inner member.

30. The method of claim 28, further comprising coupling the BHA to the outer member such that stresses experienced or created by the BHA are transferred to the outer member.

31. The method of claim 1, further comprising providing a downhole tractor and utilising the tractor to apply weight to the bit or to pull the members through the bore.

32. The method of claim 1, further comprising expanding the outer member to a larger diameter.

33. The method of claim 1, further comprising providing a sealing arrangement between the inner and outer members.

34. The method of claim 1, further comprising providing a sealing arrangement between the outer member and bore wall.

35. The method of claim 1, further comprising providing a sealing arrangement inside the inner member.

36. The method of claim 35, further comprising pumping the sealing arrangement down inside the inner member.

37. The method of claim 1, wherein at least one of the members is spoolable.

38. Apparatus for drilling and lining a bore in an earth formation, the apparatus comprising:

a tubular outer elongate member and an inner elongate member located within and selectively attached to the outer member for movement in the bore;

an annulus defined by the outer member and the inner member, wherein the annulus is adapted for fluid flow; and a drill bit mounted to one of the members.

39. The apparatus of claim 38, wherein at least one of the inner and outer members is a support member capable of transmitting force.

40. The apparatus of claim 38, wherein bath of the members are spoolable.

41. The apparatus of claim 38, wherein at least one of the members is sectional.

42. The apparatus of claim 41, wherein at least one of the members is formed of jointed pipe.

43. The apparatus of claim 38, wherein the outer member is expandable to a larger diameter.

44. The apparatus of claim 38, wherein at least one of the members is of a composite material.

45. The apparatus of claim 38, wherein the inner elongate member is tubular.

46. The apparatus of claim 38, wherein the inner and outer members are coaxial.

47. The apparatus of claim 46, wherein spacers are provided between the members.

48. The apparatus of claim 38, further comprising a downhole motor.

49. The apparatus of claim 48, wherein the motor is a positive displacement motor.

50. The apparatus of claim 38, further comprising a measurement-while-drilling (MWD) apparatus.

51. The apparatus of claim 38, wherein the drill bit is mounted to the inner member.

52. The apparatus of claim 38, wherein a coupling between the inner and outer members is remotely disengageable.

53. The apparatus of claim 38, wherein the drill bit is collapsable and retrievable through the outer member.

54. The apparatus of claim 38, wherein the drill bit is remotely disengageable from said one of the members.

55. The apparatus of claim 38, wherein the drill bit is expandable.

56. The apparatus of claim 38, wherein a bottom hole assembly (BHA) is located at least partially within the outer member.

57. The apparatus of claim 56, wherein the BHA is mounted to the inner member.

58. The apparatus of claim 56, wherein the BHA is coupled to the outer member.

59. The apparatus of claim 38, further comprising a down hole tractor.

60. The apparatus of claim 59, wherein the tractor is retractable.

61. The apparatus of claim 38, wherein at least one of the members comprises signal conductors.

62. The apparatus of claim 38, wherein the outer member comprises a pressure containment layer.

63. The apparatus of claim 38, wherein the outer member comprises an inner low friction liner or coating, to facilitate withdrawal of the inner member.

64. The apparatus of claim 38, wherein the outer member extends over the length of the inner member.

65. The apparatus of claim 38, wherein the outer member extends over only a distal portion of the inner member.

66. The apparatus of claim 38, wherein the outer member extends over only an intermediate portion of the inner member.

67. The apparatus of claim 38, wherein at least one of the members forms part of a velocity string.

68. The apparatus of claim 38, wherein a sealing arrangement is provided between the inner and outer members.

69. The apparatus of claim 38, wherein a sealing arrangement is provided for location between the outer member and a bore wall.

70. The apparatus of claim 38, wherein a sealing arrangement is provided inside the inner member to seal an inner diameter of the inner member.

71. The method of claim 38, wherein at least one of the members is spoolable.

72. A method for lining a wellbore, comprising:

providing a drilling assembly comprising an earth removal member, a tubular assembly, and a wellbore lining conduit, wherein the drilling assembly includes a first fluid flow path and a second fluid flow path and the tubular assembly is connected to and at least partially disposed in the wellbore lining conduit;

advancing the drilling assembly into the earth;

flowing a fluid through the first fluid flow path and returning at least a portion of the fluid through the second fluid flow path; and leaving the wellbore lining conduit at a location within the wellbore.

73. The method of claim 72, wherein the first and second fluid flow paths are in fluid communication when the drilling assembly is disposed in the wellbore.

74. The method of claim 72, wherein the first fluid flow path is within the tubular assembly.

75. The method of claim 74, wherein the second fluid flow path is within an annular area formed between an outer surface of the tubular assembly and an inner surface of the wellbore lining conduit.

76. The method of claim 72, wherein the first and second fluid flow paths are in opposite directions.

77. The method of claim 72, wherein the wellbore lining conduit comprises at least one fluid flow restrictor on an outer surface thereof.

78. The method of claim 72, further comprising flowing a second portion of the fluid through a third flow path.

79. The method of claim 72, wherein the earth removal member is capable of forming a hole having a larger outer diameter than an outer diameter of the wellbore lining conduit.

80. The method of claim 72, further comprising selectively altering a trajectory of the drilling assembly.

81. The method of claim 72, further comprising increasing an energy of the return fluid.

82. A method of forming a wellbore using a casing, comprising:

providing the casing with a drill bit disposed at a lower portion thereof;

forming the wellbore using the casing, the casing being apportioned into at least two fluid flow paths;

flowing a fluid downward in the casing; and flowing at least a portion of the fluid upward inside the casing.

83. A method of drilling and lining a bore in an earth formation, the method comprising the steps:

providing a tubular outer elongate member and an inner elongate member located within the outer member, at least one of the members being spoolable;

mounting a drill bit to one of the members;

drilling the bore by advancing the drill bit through the earth formation and advancing the members through the bore; and providing a downhole tractor and utilising the tractor to apply weight to the bit or to pull the members through the bore.

84. A method of drilling and lining a bore in an earth formation, the method comprising the steps:

providing a tubular outer elongate member and an inner elongate member located within the outer member, at least one of the members being spoolable;

mounting a drill bit to one of the members;

providing a sealing arrangement inside the inner member;

pumping the sealing arrangement down inside the inner member; and drilling the bore by advancing the drill bit through the earth formation and advancing the members through the bore.

85. Apparatus for drilling and lining a bore in an earth formation, the apparatus comprising:

a tubular outer elongate member and an inner elongate member located within and coupled the outer member, at least one of the members being spoolable; and a drill bit mounted to one of the members, wherein the inner and outer members are coaxial and spacers are provided between the members.

86. Apparatus for drilling and lining a bore in an earth formation, the apparatus comprising:

a tubular outer elongate member and an inner elongate member located within and coupled the outer member, at least one of the members being spoolable;

a drill bit mounted to one of the members; and a retractable downhole tractor.

87. Apparatus for drilling and lining a bore in an earth formation, the apparatus comprising:

a tubular outer elongate member and an inner elongate member located within and coupled the outer member, at least one of the members being spoolable; and a drill bit mounted to one of the members, wherein at least one of the members comprises signal conductors.

88. Apparatus for drilling and lining a bore in an earth formation, the apparatus comprising:

a tubular outer elongate member and an inner elongate member located within and coupled the outer member, at least one of the members being spoolable; and a drill bit mounted to one of the members, the outer member comprises a pressure containment layer.

89. Apparatus for drilling and lining a bore in an earth formation, the apparatus comprising:

a tubular outer elongate member and an inner elongate member located within and coupled the outer member, at least one of the members being spoolable; and a drill bit mounted to one of the members, wherein the outer member comprises an inner low friction liner or coating, to facilitate withdrawal of the inner member.

90. A method of drilling a bore in an earth formation, the method comprising:

providing an outer elongate member and an inner elongate member at least partially disposed within the outer member;

mounting a drill bit to one of the members;

flowing fluid through an inner annulus between the inner member and the outer member;

advancing the inner member, the outer member, and the drill bit through the earth formation, thereby forming the bore; and retrieving at least one of the members using an injector head and lubricator.

91. A method of drilling a bore in an earth formation, the method comprising:

providing an outer elongate member and an inner elongate member at least partially disposed within the outer member;

mounting a drill bit to one of the members;

flowing fluid through an inner annulus between the inner member and the outer member;

advancing the inner member, the outer member, and the drill bit through the earth formation, thereby forming the bore; and expanding the outer member.

92. A method of drilling a bore in an earth formation, the method comprising:

providing an outer elongate member and an inner elongate member at least partially disposed within the outer member;

mounting a drill bit to one of the members;

flowing a drilling fluid is through a channel defined by an outer annulus between the outer member and the bore wall;

flowing the drilling fluid through an inner annulus between the inner member and the outer member; and advancing the inner member, the outer member, and the drill bit through the earth formation, thereby forming the bore.

93. A method of drilling a bare in an earth formation, the method comprising:

providing an outer elongate member and an inner elongate member at least partially disposed within the outer member;

mounting a drill bit to one of the members;

flowing a drilling fluid is through a channel defined by the inner member;

returning the drilling fluid through an inner annulus between the inner member and the outer member; and advancing the inner member, the outer member, and the drill bit through the earth formation, thereby forming the bore.

94. A method of drilling a bore in an earth formation, the method comprising:

providing an outer elongate member and an inner elongate member at least partially disposed within the outer member;

mounting a drill bit to one of the members;

flowing a drilling fluid through an inner annulus between the inner member and the outer member, wherein the fluid serves as a medium for transmission of pressure pulse signals from a measurement-while-drilling (MWD) apparatus to surface; and advancing the inner member, the outer member, and the drill bit through the earth formation, thereby forming the bore.

95. A method of drilling a bore in an earth formation, the method comprising:

providing an outer elongate member and an inner elongate member at least partially disposed within the outer member;

mounting a drill bit to one of the members;

flowing a drilling fluid through an inner annulus between the inner member and the outer member;

advancing the inner member, the outer member, and the drill bit through the earth formation, thereby forming the bore; and pumping a gas into the bore during drilling.

96. The method of claim 95, wherein the gas is mixed with the fluid at surface.

97. The method of claim 95, wherein the gas is pumped into the bore separately of the fluid and mixed with the drilling fluid at or adjacent the drill bit.

98. The method of claim 95, wherein the presence of gas is utilized to increase the effective buoyancy of the members.

99. A method of drilling a bore in an earth formation, the method comprising:

providing an outer elongate member and an inner elongate member at least partially disposed within the outer member;

mounting a drill bit to one of the members;

flowing fluid through an inner annulus between the inner member and the outer member;

advancing the inner member, the outer member, and the drill bit through the earth formation, thereby forming the bore; and closing a channel at least partially defined by one or more of the members.

100. A method of drilling a bore in an earth formation, the method comprising:

providing an outer elongate member and an inner elongate member at least partially disposed within the outer member;

mounting a drill bit to one at the members;

flowing fluid through an inner annulus between the inner member and the outer member; and advancing the inner member, the outer member, and the drill bit through the earth formation, thereby forming the bore; and expanding the outer member to a larger diameter.

101. A method of drilling a bore in an earth formation, the method comprising:

providing an outer elongate member and an inner elongate member at least partially disposed within the outer member;

mounting a drill bit to one of the members;

flowing fluid through an inner annulus between the inner member and the outer member;

advancing the inner member, the outer member, and the drill bit through the earth formation, thereby forming the bore; and providing a sealing arrangement between the inner and outer members.

102. A method of drilling a bore in an earth formation, the method comprising:

providing an outer elongate member and an inner elongate member at least partially disposed within the outer member;

mounting a drill bit to one of the members;

flowing fluid through an inner annulus between the inner member and the outer member;

advancing the inner member, the outer member, and the drill bit through the earth formation, thereby forming the bore; and providing a sealing arrangement between the outer member and bore wall.

103. A method of drilling a bore in an earth formation, the method comprising:

providing an outer elongate member and an inner elongate member at least partially disposed within the outer member;

mounting a drill bit to one of the members;

flowing fluid through an inner annulus between the inner member and the outer member;

advancing the inner member, the outer member, and the drill bit through the earth formation, thereby forming the bore; and providing a sealing arrangement inside the inner member.

104. The method of claim 103, further comprising pumping the sealing arrangement down inside the inner member.

105. A method for lining a wellbore, comprising:

providing a drilling assembly comprising an earth removal member and a wellbore lining conduit, wherein the drilling assembly includes a first fluid flow path and a second fluid flow path;

advancing the drilling assembly into the earth;

flowing a fluid through the first fluid flow path and returning at least a portion of the fluid through the second fluid flow path;

flowing a second portion of the fluid through a third flow path; and leaving the wellbore lining conduit at a location within the wellbore.

106. A method for lining a wellbore, comprising:

providing a drilling assembly comprising an earth removal member and a wellbore lining conduit, wherein the drilling assembly includes a first fluid flow path and a second fluid flow path;

advancing the drilling assembly into the earth;

flowing a fluid through the first fluid flow path and returning at least a portion of the fluid through the second fluid flow path;

selectively altering a trajectory of the drilling assembly; and leaving the wellbore lining conduit at a location within the wellbore.

107. A method of drilling a bore in an earth formation, comprising:

providing an outer elongate member and an inner elongate member at least partially disposed within the outer member, wherein at least one of the members is spoolable;

mounting a drill bit to one of the members;

flowing fluid through an inner annulus between the inner member and the outer member; and advancing the inner member, the outer member, and the drill bit through the earth formation, thereby forming the bore.

108. A method of drilling a bore in an earth formation, comprising:

providing an outer elongate member and an inner elongate member at least partially disposed within the outer member;

mounting a drill bit to one of the members;

flowing fluid through an inner annulus between the inner member and the outer member;

advancing the inner member, the outer member, and the drill bit through the earth formation, thereby forming the bore; and producing a hydrocarbon fluid while forming the bore.

* * * * *

UNITED STATES PATENT AND TRADEMARK OFFICE

CERTIFICATE OF CORRECTION

PATENT NO. : 7,093,675 B2
APPLICATION NO. : 10/343687
DATED : August 22, 2006
INVENTOR(S) : Giancarlo Pia It is certified that error appears in the above-identified patent and that said Letters Patent is hereby corrected as shown below:

On the Title Page, Item (56) References Cited:

Under U.S. PATENT DOCUMENTS, please delete "1,996,833 A" and insert --1,998,833 A--.

Under U.S. PATENT DOCUMENTS, please delete "3,748,330 A" and insert --3,746,330 A--.

Under U.S. PATENT DOCUMENTS, please delete "GB 1 306 588" and insert --GB 1 306 568--.

Under FOREIGN PATENT DOCUMENTS, please delete "WO 00/04259" and insert --WO 00/04269--.

Signed and Sealed this

Twenty-second Day of May, 2007

JON W. DUDAS
*Director of the United States Patent and Trademark Office*